US008452587B2

(12) United States Patent
Liu et al.

(10) Patent No.: US 8,452,587 B2
(45) Date of Patent: May 28, 2013

(54) ENCODER, DECODER, AND THE METHODS THEREFOR

(75) Inventors: Zongxian Liu, Singapore (SG); Kok Seng Chong, Singapore (SG)

(73) Assignee: Panasonic Corporation, Osaka (JP)

( * ) Notice: Subject to any disclaimer, the term of this patent is extended or adjusted under 35 U.S.C. 154(b) by 277 days.

(21) Appl. No.: 12/990,706

(22) PCT Filed: May 29, 2009

(86) PCT No.: PCT/JP2009/002384
§ 371 (c)(1),
(2), (4) Date: Nov. 2, 2010

(87) PCT Pub. No.: WO2009/144953
PCT Pub. Date: Dec. 3, 2009

(65) Prior Publication Data

US 2011/0046946 A1 Feb. 24, 2011

(30) Foreign Application Priority Data

May 30, 2008 (JP) ..... 2008-143863
Jun. 19, 2008 (JP) ..... 2008-160954

(51) Int. Cl.
*G10L 19/08* (2006.01)
*G10L 19/024* (2012.01)

(52) U.S. Cl.
USPC ..... 704/203; 704/204; 704/222

(58) Field of Classification Search
USPC ..... 704/500–504
See application file for complete search history.

(56) References Cited

U.S. PATENT DOCUMENTS 5,483,534 A * 1/1996 Ohki et al. ..... 370/535
6,571,227 B1 * 5/2003 Agrafiotis et al. ..... 706/15

(Continued)

FOREIGN PATENT DOCUMENTS

JP 2002-223455 8/2002
JP 2005-522721 7/2005

(Continued)

OTHER PUBLICATIONS

Dal Yang, Hongmei Al, Chris Kyriakakis and C.-C. Jay Kuo, vol. 11, No. 4, "High-fidelity multichannel audio coding with Karhunen Lôeve Transform", IEEE transactions on speech and audio processing, Jul. 2003, vol. 11, No. 4, pp. 365-380.

(Continued)

*Primary Examiner* — Jialong He
*Assistant Examiner* — Jie Shan
(74) *Attorney, Agent, or Firm* — Greenblum & Bernstein, P.L.C.

(57) ABSTRACT

Provided is an encoder which can decode a high-quality stereo signal while keeping the amount of information in the bit allocation information to a minimum when a scalable coding technique is used for a stereo signal. In the encoder, a principal component analysis (PCA) converter converts the left signal and the right signal of the stereo signal and generates the main signal of the first layer and the sub-signal of the first layer. In the first layer to the M-th layer (where M is a natural number, 2 or greater), an adaptive residual encoder compares the importance of the main signal of the m-th layer, where m is a natural number from 1 to M, and the importance of the sub-signal of the m-th layer, selects the signal having the higher importance, encodes the selected signal, and generates the encoded data of the m-th layer. From the first layer to the M−1-st layer, the adaptive residual encoder generates the signal obtained by subtracting the decoded signal of the encoded data of the m-th layer from the selected signal as the main signal of the m+1-st layer, and generates the unselected signal as the sub-signal of the m+1-st layer.

7 Claims, 17 Drawing Sheets

U.S. PATENT DOCUMENTS

| | | | | |
|---|---|---|---|---|
| 7,599,835 | B2 * | 10/2009 | Moriya et al. | 704/226 |
| 7,751,572 | B2 * | 7/2010 | Villemoes et al. | 381/23 |
| 8,036,904 | B2 * | 10/2011 | Myburg et al. | 704/500 |
| 8,218,775 | B2 * | 7/2012 | Norvell et al. | 381/23 |
| 2005/0091051 | A1 * | 4/2005 | Moriya et al. | 704/229 |
| 2005/0141721 | A1 * | 6/2005 | Aarts et al. | 381/16 |
| 2005/0213522 | A1 * | 9/2005 | Aarts et al. | 370/278 |
| 2006/0195314 | A1 * | 8/2006 | Taleb et al. | 704/200.1 |
| 2006/0233379 | A1 * | 10/2006 | Villemoes et al. | 381/23 |
| 2008/0004883 | A1 * | 1/2008 | Vilermo et al. | 704/500 |
| 2008/0195397 | A1 * | 8/2008 | Myburg et al. | 704/500 |
| 2009/0083045 | A1 * | 3/2009 | Briand et al. | 704/500 |
| 2009/0271184 | A1 * | 10/2009 | Goto et al. | 704/223 |
| 2009/0279598 | A1 * | 11/2009 | Moriya et al. | 375/240 |
| 2010/0235171 | A1 * | 9/2010 | Takagi et al. | 704/500 |
| 2010/0322429 | A1 * | 12/2010 | Norvell et al. | 381/22 |
| 2010/0332239 | A1 * | 12/2010 | Kim et al. | 704/500 |
| 2011/0004466 | A1 * | 1/2011 | Morii | 704/201 |
| 2011/0046946 | A1 * | 2/2011 | Liu et al. | 704/203 |
| 2011/0125495 | A1 * | 5/2011 | Morii et al. | 704/230 |
| 2012/0063604 | A1 * | 3/2012 | Myburg et al. | 381/22 |

FOREIGN PATENT DOCUMENTS

| | | |
|---|---|---|
| JP | 2005/522722 | 7/2005 |
| WO | 2006/103581 | 10/2006 |
| WO | 2007/104883 | 9/2007 |

OTHER PUBLICATIONS

Manuel Briand, David Virette and Nadine Martin, "Parametric coding of stereo audio based on principal component analysis", Proc of the 9th, Int. Conference, Sep. 18-20, 2006, pp. 291-296.

Robbert G van der Waal et al., "Subband coding of stereophonic digital audio signals", Proc. of IcASSP 1 91, Apr. 14, 1991, vol. 5, pp. 3601-3604.

"Series G: Transmission System and Media, Digital System and Networks; Digital Terminal Equipments-Coding of analogue signals by methods other than their PCM", ITU-T Recommendation G.729. 1, , pp. 1-91.

U.S. Appl. No. 12/990,697 to Toshiyuki Morii et al., which was filed Nov. 2, 2010.

* cited by examiner

ENCODER, DECODER, AND THE METHODS THEREFOR

TECHNICAL FIELD

The present invention relates to an encoding apparatus, decoding apparatus, and encoding and decoding methods adopting a principal component analysis transformation.

BACKGROUND ART

In conventional speech communication systems, monaural speech signals are transmitted under the constraint of a limited transmission band. With broadbandization of communication networks, user's expectation on speech communication has risen from mere intelligibility to stereo image and naturalness, and a trend to deliver stereo speech has emerged. Therefore, a coding scheme for transmitting stereo speech efficiently is desired.

To achieve the above goal, encoding methods using PCA (Principal Component Analysis) have been studied as a method of encoding a stereo signal (i.e. two channels) or a plurality of channels (see Non-Patent Literature 1 and Non-Patent Literature 2). In an encoding method using PCA, an input signal is transformed by PCA (PCA-transformation) and each transformed signal is encoded independently. PCA transformation refers to linear transformation that achieves energy concentration in an input signal according to the distribution of eigenvalues obtained from the co-variance matrix of the input signal.

For example, a PCA-transformed stereo signal is transformed into a principal signal corresponding to principal components of the stereo signal (e.g. audio signal components or dominant speech components), and a secondary signal corresponding to the rest of the components other than the principal signal of the stereo signal. That is, the energy of the stereo signal is concentrated on the principal signal. By this means, with an encoding method using PCA, it is possible to remove the redundancy in an input signal by encoding signals in which energy is concentrated, so that it is possible to improve the efficiency of coding. Also, the principal signal and the secondary signal of a stereo signal are mutually uncorrelated, so that it is possible to further remove the redundancy in an input signal.

FIG. 1 and FIG. 2 are block diagrams showing a general encoding apparatus and decoding apparatus of stereo signal codec using PCA. In the encoding apparatus shown in FIG. 1, PCA transformation section 11 transforms left signal L(n) and right signal R(n) of a stereo signal into primary signal P(n) and secondary signal A(n) (equation 1).

[1]

$$P(n)=v_1\times L(n)+v_2\times R(n)$$

$$A(n)=-v_2\times L(n)+v_1\times R(n) \qquad \text{(Equation 1)}$$

Here, $v_1$ and $v_2$ refer to the PCA transformation parameters to use to transform left signal L(n) and right signal R(n) into primary signal P(n) and secondary signal A(n). Encoding section 12 and encoding section 13 encode primary signal P(n) and secondary signal A(n) independently (e.g. scalar quantization or vector quantization), and output encoded data of primary signal P(n) and encoded data of secondary signal A(n) to multiplexing section 15. Also, quantizing section 14 quantizes PCA transformation parameters $v_1$ and $v_2$ obtained in PCA transformation section 11, and generates quantized codes of the PCA transformation parameters. Multiplexing section 15 multiplexes the encoded data of primary signal P(n), the encoded data of secondary signal A(n) and the quantized codes of the PCA transformation parameters, and generates bit streams.

Upon decoding a stereo signal in a decoding apparatus shown in FIG. 2, demultiplexing section 21 demultiplexes bit streams into encoded data of primary signal P(n), encoded data of secondary signal A(n) and quantized codes of PCA transformation parameters. Then, decoding section 22 decodes the encoded data of primary signal P(n) and obtains decoded primary signal P(n). Also, decoding section 23 decodes the encoded data of secondary signal A(n) and obtains decoded secondary signal A(n). Also, dequantizing section 24 dequantizes the quantized codes of PCA transformation parameters and obtains PCA transformation parameters $v_1$ and $v_2$. Inverse PCA transformation section 25 performs an inverse PCA transformation of primary signal P(n) and secondary signal A(n) using PCA transformation parameters $v_1$ and $v_2$, and generates left signal L(n) and right signal R(n) of a stereo signal (equation 2).

[2]

$$\tilde{L}(n)=\tilde{v}_1\times\tilde{P}(n)-\tilde{v}_2\times\tilde{A}(n)$$

$$\tilde{R}(n)=\tilde{v}_2\times\tilde{P}(n)+\tilde{v}_1\times\tilde{A}(n) \qquad \text{(Equation 2)}$$

Also, according to speech communication systems, in speech data communication on IP networks, speech coding providing a scalable configuration is demanded to realize traffic control on networks and multicast communication. A scalable configuration refers to a configuration in which the receiving side can decode speech data even from partial encoded data. As a speech encoding technique providing a scalable configuration, scalable encoding (layer encoding) techniques integrating a plurality of encoding techniques in a layered manner have been studied. In scalable encoding techniques, the transmitting side performs layered coding processing of input speech signals and transmits encoded data layered in a plurality of encoded layers.

Also, in speech communication systems, there is a demand to compress speech signals at a low bit rate and transmit the results for efficient use of radio resources. Under a low bit rate constraint, when stereo signal coding is performed using the above PCA, it is difficult to encode both the primary signal and the secondary signal in high quality. Consequently, it is necessary to adequately allocate limited bits to the primary signal and the secondary signal. For example, Non-Patent Literature 1 and Non-Patent Literature 2 disclose a bit allocation method in stereo signal coding using PCA.

Non-Patent Literature 1 discloses a method of applying parametric coding to a secondary signal in stereo signal coding processing. That is, in a primary signal and a secondary signal, the secondary signal is represented as a parameter (parametric coding parameter) based on the difference between the characteristic of primary signal encoded data and the characteristic of the secondary signal. By applying parametric coding to the secondary signal, the redundancy of the secondary signal is removed, which decreases the bit rate of the secondary signal. By this means, primary signal encoded data and parametric coding parameter (secondary signal) with a low bit rate are allocated to limited bits.

Non-Patent Literature 2 discloses a bit allocation method of adaptively allocating bits according to the energy of each of a plurality of channels obtained by applying PCA transformation to an input signal. For example, in stereo signal coding processing, bits are adaptively allocated according to the energy of each of a primary signal and a secondary signal obtained by applying PCA transformation to a stereo signal (i.e. two channels). By this means, it is possible to preferentially transmit the channel of higher energy among a plurality of channels after PCA transformation. Also, under a low bit rate constraint, it is possible to discard the channel of lower energy among a plurality of channels forming a stereo signal. This transmission method is referred to as "channel scalability transmission method."

CITATION LIST

Non-Patent Literature

[NPL 1]

Manuel Briand, David Virette and Nadine Martin "Parametric coding of stereo audio based on principal component analysis", Proc of the 9th International Conference on Digital Audio Effects, Montreal, Canada, Sep. 18-20, 2006.

[NPL 2]

Dai Yang, Hongmei Ai, Chris Kyriakakis and C.-C. Jay Kuo "High-fidelity multichannel audio coding with Karhunen Lóeve Transform", IEEE transactions on speech and audio processing, Vol. 11, No. 4, July 2003.

SUMMARY OF INVENTION

Technical Problem

However, in scalable coding systems using a scalable coding technique for stereo signals, if the above bit allocation method is adopted, the amount of information (the number of bits) of bit allocation information to be reported from the encoding apparatus to the decoding apparatus increases, and therefore the efficiency of coding degrades.

To be more specific, if the bit allocation method disclosed in Non-Patent Literature 1 is applied to a scalable coding system, a parametric coding parameter based on a principal signal subjected to scalable coding needs to be updated in each coding layer of scalable coding. Also, this parametric coding parameter requires a predetermined number of bits in each coding layer. That is, the encoding apparatus needs to report, to the decoding apparatus, bit allocation information indicating the amount of information (number of bits) of the parametric coding parameter that varies between coding layers, and therefore the efficiency of coding degrades.

Also, if the bit allocation method disclosed in Non-Patent Literature 2 is applied to a scalable coding system, the number of bits allocated to the primary signal and secondary signal of a stereo signal varies between coding layers. Consequently, the encoding apparatus needs to report, to the decoding apparatus, bit allocation information indicating the number of bits allocated to the primary signal and the secondary signal, and therefore the efficiency of coding degrades.

Thus, in a scalable coding system, when bits are allocated to the primary signal and secondary signal obtained by applying PCA transformation to a stereo signal, it is necessary to report bit allocation information of predetermined bits every coding layer, which increases the amount of bit allocation information to be reported to decoded signals.

It is therefore an object of the present invention to provide an encoding apparatus, decoding apparatus, and encoding and decoding methods for minimizing the amount of bit allocation information and generating stereo signals of high quality upon using a scalable coding technique for stereo signals.

Solution to Problem

The encoding apparatus of the present invention employs a configuration having: a transformation section that performs principal component analysis transformation of a first channel signal and a second channel signal of an input stereo signal, to generate a first layer primary signal and a first layer secondary signal; an m-th layer selecting section that compares importance of an m-th layer primary signal (where m is a natural number equal to or greater than 1 and equal to or less than M) and importance of an m-th layer secondary signal in a first layer to an M-th layer (where M is a natural number equal to or greater than 2), and selects a signal of higher importance; an m-th layer encoding section that encodes the signal selected in the m-th layer selecting section, to generate m-th layer encoded data in the first layer to the M-th layer; an m-th layer decoding section that decodes the m-th encoded data to generate an m-th layer decoded signal in the first layer to an (M−1)-th layer; a subtracting section that generates a signal obtained by subtracting the m-th layer decoded signal from the signal selected in the m-th layer selecting section, and a signal that is not selected in the m-th layer selecting section, as an (m+1)-th layer primary signal and an (m+1)-th layer secondary signal, in the first layer to the (M−1)-th layer; and a transmitting section that transmits encoded data of the first layer to the M-th layer and signal information indicating signals selected in selecting sections in the first layer to the M-th layer.

Advantageous Effects of Invention

According to the present invention, upon using a scalable coding technique for stereo signals, the encoding apparatus encodes only the signal of the higher importance between two signals of a primary signal and a secondary signal obtained by applying PCA transformation to a stereo signal in each coding layer, so that it is possible to minimize the amount of bit allocation information while the decoding side can generate stereo signals of high quality.

DESCRIPTION OF EMBODIMENTS

Now, embodiments of the present invention will be explained using the accompanying drawings.

(Embodiment 1)

Figure 1:
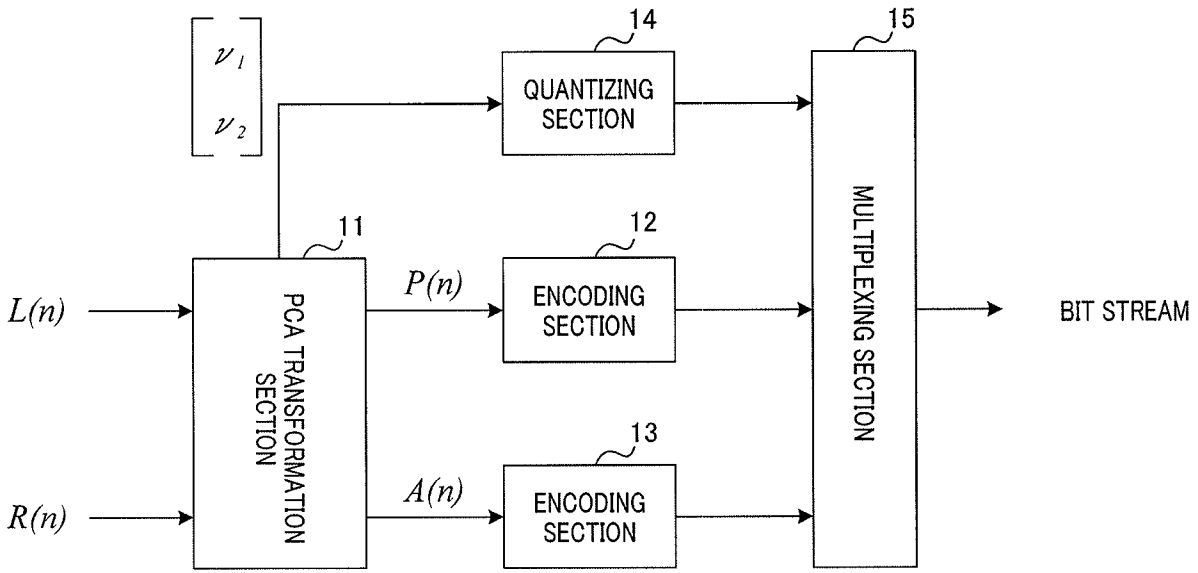
FIG.1 PRIOR ART
FIG. 1 is a block diagram showing a configuration of a general encoding apparatus using PCA.
Figure 2:
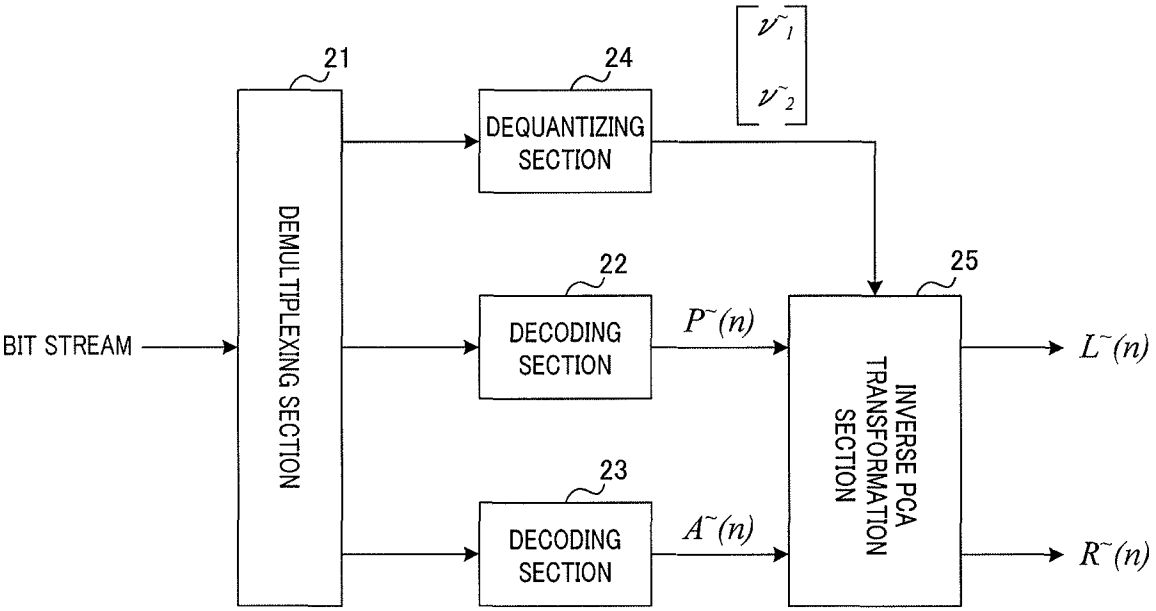
FIG.2 PRIOR ART
FIG. 2 is a block diagram showing a configuration of a general decoding apparatus using PCA.
Figure 3:
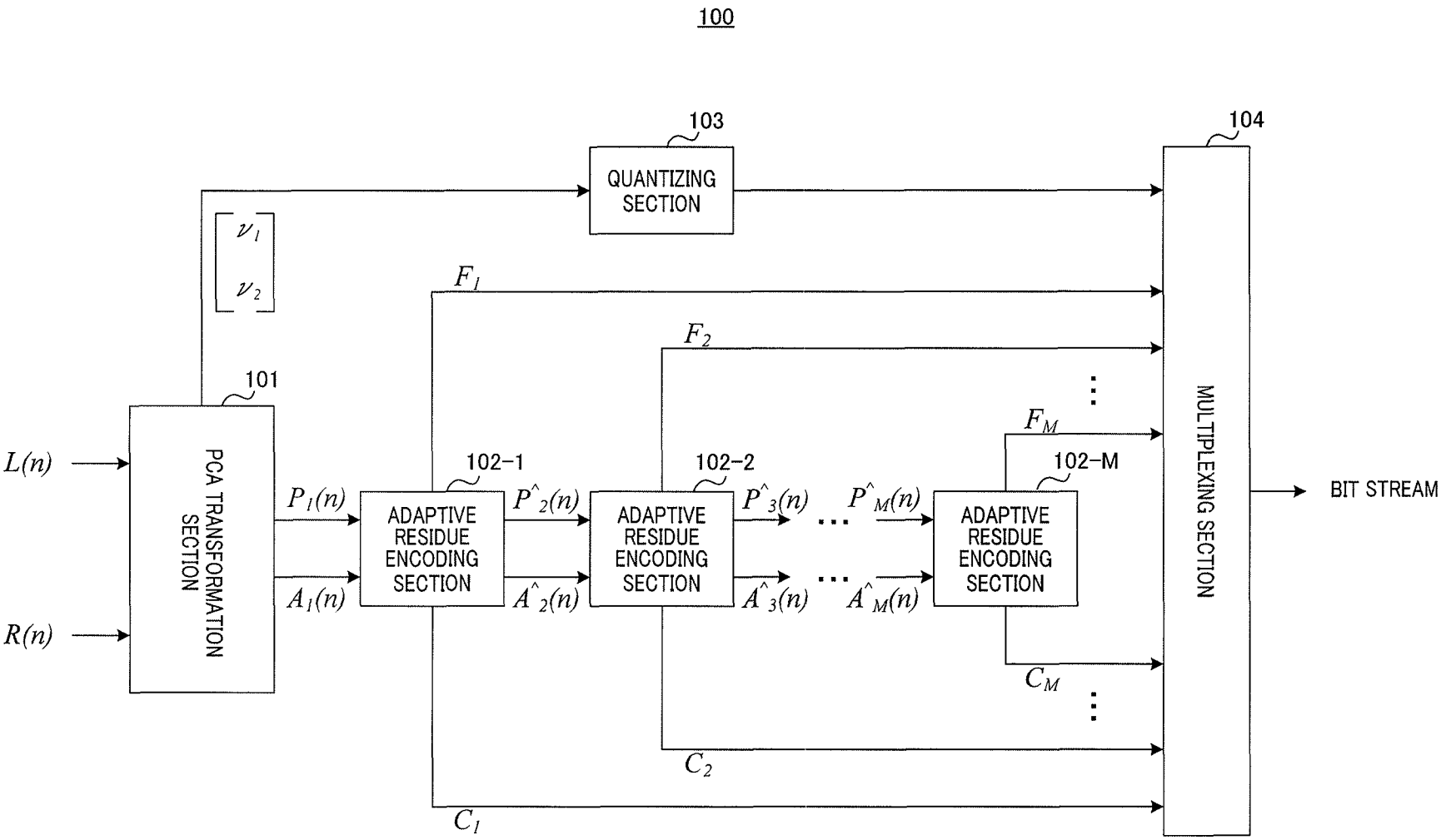
FIG. 3 is a block diagram showing a configuration of an encoding apparatus according to Embodiment 1 of the present invention.
Figure 7:
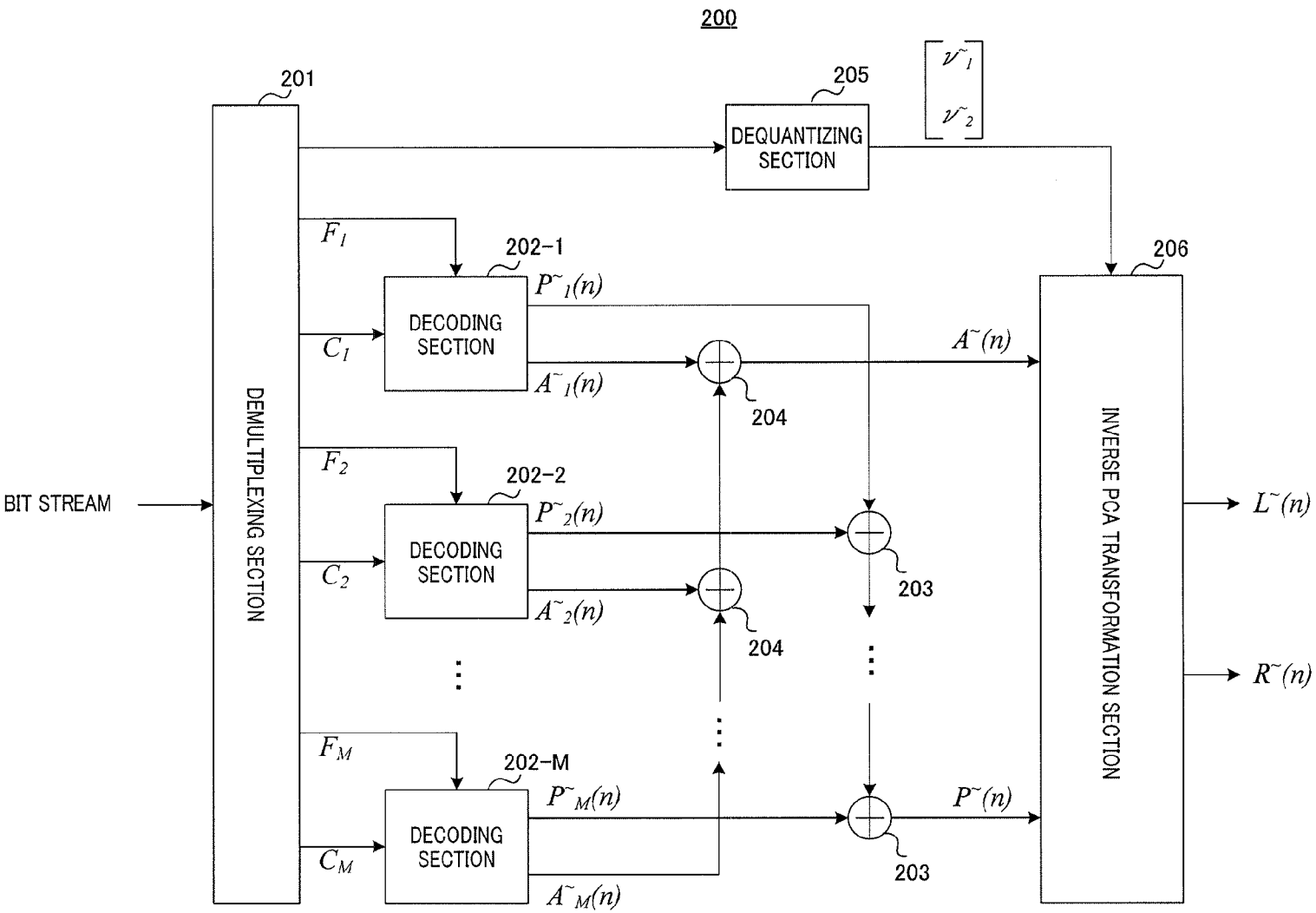
FIG. 7 is a block diagram showing a configuration of a decoding apparatus according to Embodiment 1 of the present invention.

FIG. 3 is a block diagram showing the configuration of an encoding apparatus according to the present embodiment, and FIG. 7 is a block diagram showing the configuration of a decoding apparatus according to the present embodiment. As an example, a scalable configuration of M layers will be explained as the configurations of the encoding apparatus and decoding apparatus according to the present embodiment. That is, in the following explanation, assume that the number of coding layers is M (M is a natural number equal to or greater than 2) in scalable coding processing. In encoding apparatus 100 shown in FIG. 3, adaptive residue encoding sections 102-1 to 102-M support the first layer to the M-th layer, respectively. Similarly, in decoding apparatus 200 shown in FIG. 7, decoding sections 202-1 to 202-M support the first layer to the M-th layer, respectively. Also, in the following explanation, the left signal and the right signal of a stereo signal are divided every NB samples (NB is a natural number), and NB samples form one frame. Here, the left signal and the right signal are represented by left signal L(n) and right signal R(n), respectively. Also, n represents the (n+1)-th signal element in a signal divided every NB samples, and n equals to numbers between 0 to NB−1.

In encoding apparatus 100 shown in FIG. 3, PCA transformation section 101 receives as input left signal L(n) and right signal R(n) of a stereo signal. PCA transformation section 101 performs a PCA transformation of input left signal L(n) and right signal R(n) according to equation 1, to generate first layer primary signal $P_1(n)$ and first layer secondary signal $A_1(n)$. Then, PCA transformation section 101 outputs first layer primary signal $P_1(n)$ and first layer secondary signal $A_1(n)$ to adaptive residue encoding section 102-1. Further, PCA transformation section 101 outputs PCA transformation parameters $v_1$ and $v_2$ calculated upon PCA transformation processing, to quantizing section 103.

Adaptive reissue encoding sections 102-1 to 102-M adaptively each select one of the two signals based on the importance of the primary signal and the importance of the secondary signal in the corresponding coding layer, and encode the selected signal (i.e. adaptive residue encoding). To be more specific, in the first layer to the M-th layer, adaptive residue encoding section 102-m (m is a natural number equal to or greater than 1 and equal to or less than M) compares the importance of the m-th layer primary signal and the importance of the m-th layer secondary signal, selects the signal of the higher importance and generates m-th layer encoded data (bit sequence) by encoding the selected signal. Also, in the first layer to the (M−1)-th layer, adaptive residue encoding section 102-m generates a residual signal obtained by subtracting a decoded signal of encoded data from the selected signal, and the other signal than the selected signal, as the (m+1)-th layer primary signal and the (m+1)-th layer secondary signal, respectively. Also, in the first layer to the M-th layer, adaptive residue encoding section 102-m generates an indicator representing signal information to indicate an encoded signal (primary signal or secondary signal). For example, if a signal indicated by the indicator is a primary signal, an encoded signal is the m-th layer primary signal, and, if a signal indicated by the indicator is a secondary signal, an encoded signal is the m-th layer secondary signal. That is, an indicator is generated as bit allocation information to indicate a signal allocated to the bit sequence for encoded data set in each coding layer.

For example, adaptive residue encoding section 102-1, which supports the lowest layer (i.e. first layer), applies adaptive residue encoding processing to first layer primary signal $P_1(n)$ and first layer secondary signal $A_1(n)$ received as input from PCA transformation section 101, and generates first layer encoded data $C_1$. Also, adaptive residue encoding section 102-1 generates a residual signal obtained by subtracting a decoded signal of encoded data $C_1$ from the encoded signal (the selected signal) in the input signals (first layer primary signal $P_1(n)$ and first layer secondary signal $A_1(n)$) and generates the other signal (i.e. the signal that is not selected) than the encoded signal (i.e. the selected signal) in the input signals (first layer primary signal $P_1(n)$ and first layer secondary signal $A_1(n)$), as second layer primary signal $\hat{P}_2(n)$ and second layer secondary signal $\hat{A}_2(n)$. Also, adaptive residue encoding section 102-1 generates indicator $F_1$ indicating a signal encoded in the first layer (i.e. first layer primary signal $P_1(n)$ or first layer secondary signal $A_1(n)$). Then, adaptive residue encoding section 102-1 outputs second layer primary signal $\hat{P}_2(n)$ and second layer secondary signal $\hat{A}_2(n)$ to adaptive residue encoding section 102-2 supporting the next coding layer (i.e. a second layer), and outputs indicator $F_1$ and encoded data $C_1$ to multiplexing section 104.

Similarly, adaptive residue encoding section 102-2 receives second layer primary signal $\hat{P}_2(n)$ and second layer secondary signal $\hat{A}_2(n)$ as input from adaptive residue encoding section 102-1. Then, in the same way as in adaptive residue encoding section 102-1, adaptive residue encoding section 102-2 generates second layer encoded data $C_2$, third layer primary signal $\hat{P}_3(n)$, third layer secondary signal $\hat{A}_3(n)$ and indicator $F_2$. Then, adaptive residue encoding section 102-2 outputs third layer primary signal $\hat{P}_3(n)$ and third layer secondary signal $\hat{A}_3(n)$ to adaptive residue encoding section 102-3 supporting the next coding layer (i.e. a third layer), and outputs indicator $F_2$ and encoded data $C_2$ to multiplexing section 104. The same applies to adaptive residue encoding sections 102-3 to 102-M. Here, adaptive residue encoding section 102-M supporting the highest layer (i.e. M-th layer) does not output coding residual signals as the primary signal and secondary signal of the next coding layer. That is, only in the first layer to the (M−1)-th layer, that is, only adaptive residue encoding sections 102-1 to 102-(M−1)

generate a coding residual signal obtained by subtracting a decoded signal of encoded data from a selected signal, and a signal that is not selected, as the (m+1)-th layer primary signal and the (m+1)-th layer secondary signal, respectively.

Quantizing section 103 quantizes PCA transformation parameters $v_1$ and $v_2$ received as input from PCA transformation section 101, and generates quantized codes of the PCA transformation parameters. Then, quantizing section 103 outputs the quantized codes of PCA transformation parameters to multiplexing section 104.

Multiplexing section 104 multiplexes encoded data $C_m$ and indicators $F_m$ individually received as input from adaptive residue encoding sections 102-1 to 102-M, and the quantized codes received as input from quantizing section 103, and generates bit streams. The resulting bit streams are transmitted to decoding apparatus 200 (FIG. 7) via the communication path.

Figure 4:
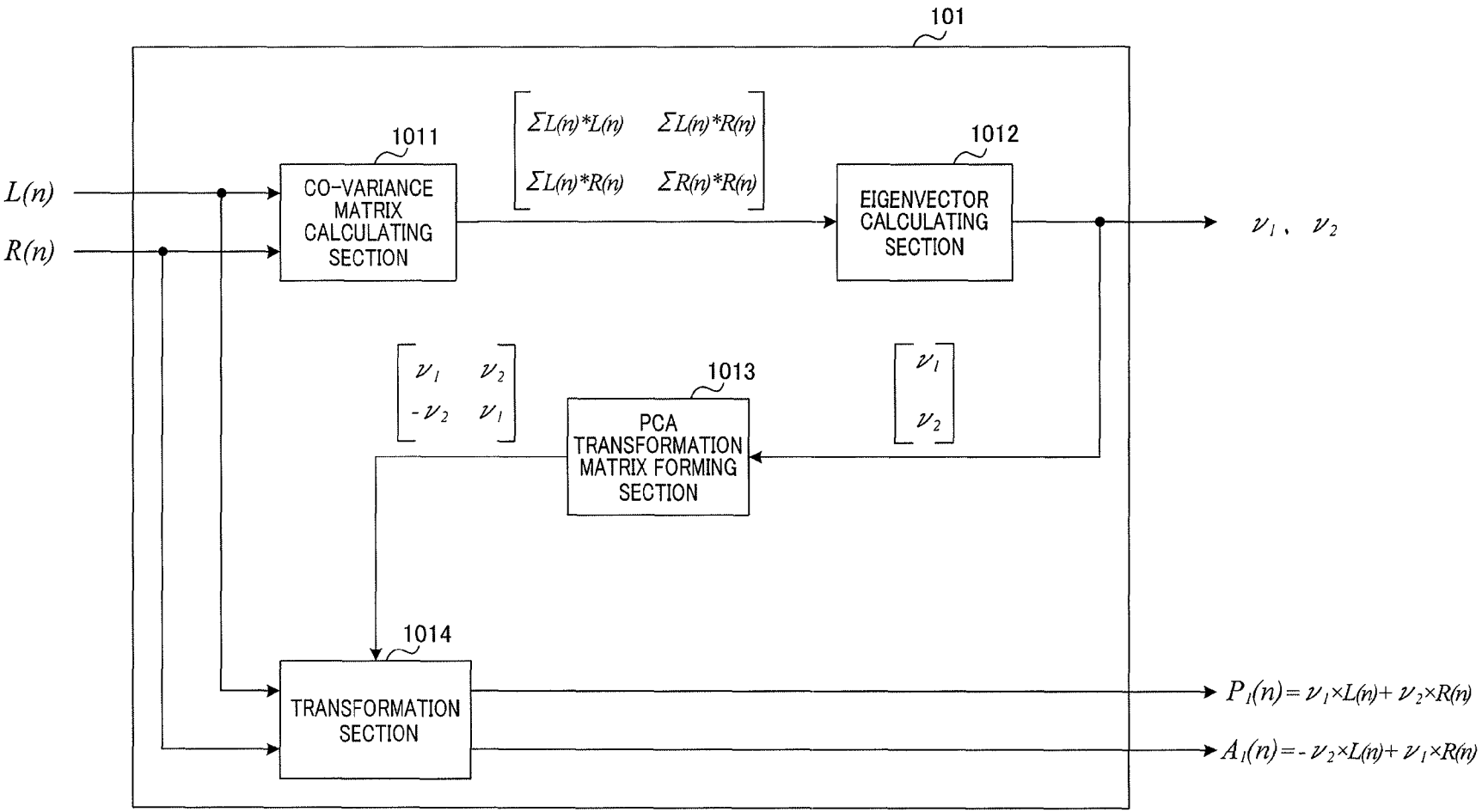
FIG. 4 is a block diagram showing a configuration inside a PCA transformation section according to Embodiment 1 of the present invention.

FIG. 4 is a block diagram showing the configuration inside PCA transformation section 101. Co-variance matrix calculating section 1011 calculates a co-variance matrix using left signal L(n) and right signal R(n) in frame units of a stereo signal, and outputs the calculated co-variance matrix to eigenvector calculating section 1012.

Eigenvector calculating section 1012 calculates a co-variance matrix eigenvector using the co-variance matrix received as input from co-variance matrix calculating section 1011. Here, the elements of the eigenvector calculated in eigenvector calculating section 1012 are PCA transformation parameters $v_1$ and $v_2$. Then, eigenvector calculating section 1012 outputs the calculated eigenvector (PCA transformation parameters) to PCA transformation matrix forming section 1013 and quantizing section 103 shown in FIG. 3.

PCA transformation matrix forming section 1013 forms a PCA transformation matrix using the eigenvector received as input from eigenvector calculating section 1012, and outputs the formed PCA transformation matrix to transformation section 1014.

Transformation section 1014 transforms left signal L(n) and right signal R(n) of a stereo signal into first layer primary signal $P_1(n)$ and first layer secondary signal $A_1(n)$, using the PCA transformation matrix received as input from PCA transformation matrix forming section 1013. Here, $P_1(n)=P(n)$ and $A_1(n)=A(n)$).

Figure 5:
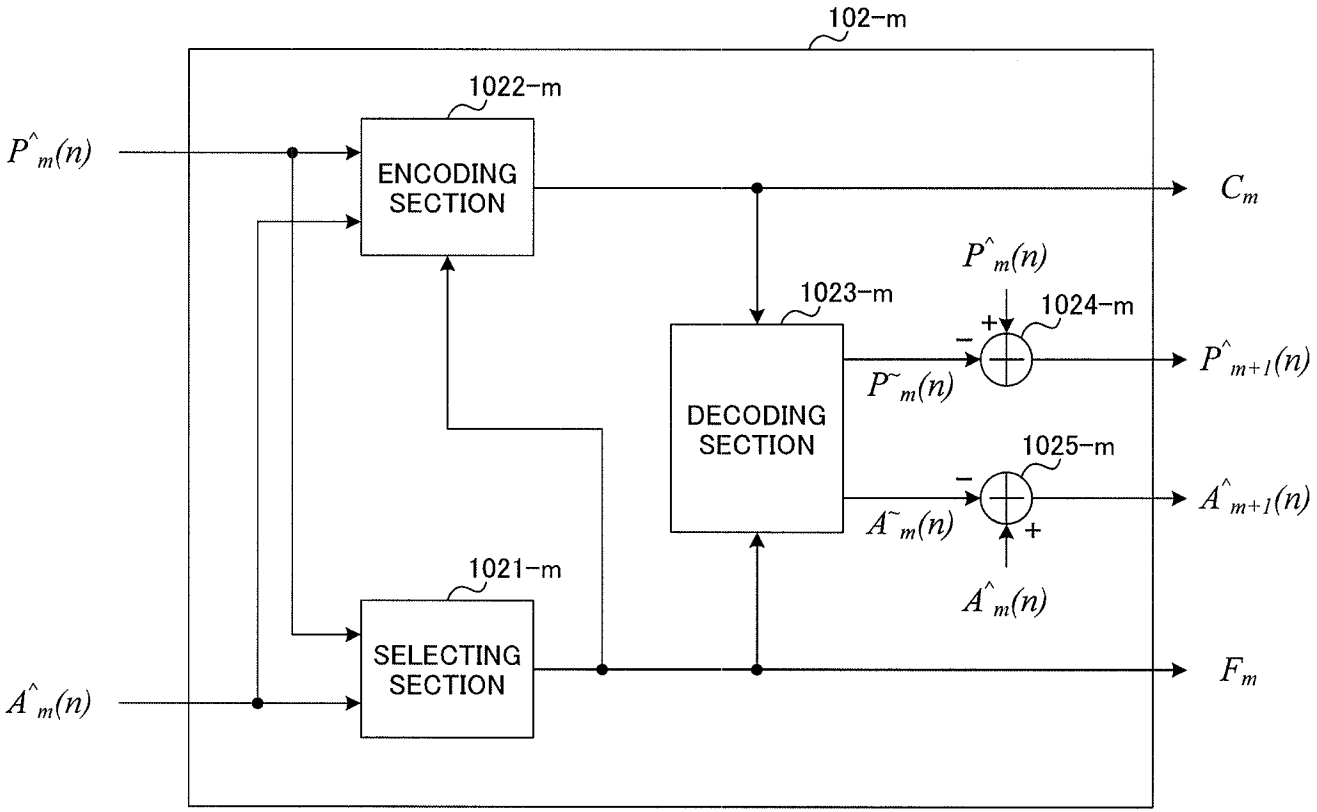
FIG. 5 is a block diagram showing a configuration inside an adaptive residue encoding section according to Embodiment 1 of the present invention.

Next, as an example of adaptive residue encoding processing in adaptive residue encoding sections 102-1 to 102-M, the configuration inside adaptive residue encoding section 102-m supporting the m-th layer will be explained using FIG. 5. FIG. 5 is a block diagram showing the configuration inside adaptive residue encoding section 102-m. Adaptive residue encoding section 102-m shown in FIG. 5 receives m-th layer primary signal $P^\wedge_m(n)$ and m-th layer secondary signal $A^\wedge_m(n)$ as input from adaptive residue encoding section 102-(m−1) supporting the (m−1)-th layer, which is lower by one. To be more specific, selecting section 1021-m and encoding section 1022-m shown in FIG. 5 receive m-th layer primary signal $P^\wedge_m(n)$ and m-th layer secondary signal $A^\wedge_m(n)$ as input. Also, subtractor 1024-m shown in FIG. 5 receives m-th layer primary signal $P^\wedge_m(n)$ as input, and subtractor 1025-m receives m-th layer secondary signal $A^\wedge_m(n)$ as input. Here, adaptive residue encoding section 102-m supporting the first layer shown in FIG. 5 receives first layer primary signal $P_1(n)$ and first layer secondary signal $A_1(n)$ as input from PCA transformation section 101. Also, adaptive residue encoding section 102-M supporting the highest layer (i.e. M-th layer) includes only selecting section 1021-m and encoding section 1022-m shown in FIG. 5, and does not include decoding section 1023-m, subtractor 1024-m and subtractor 1025-m. That is, adaptive residue encoding section 102-M outputs only indicator $F_m$ and encoded data $C_m$.

In adaptive residue encoding section 102-m shown in FIG. 5, selecting section 1021-m compares the energy of input m-th layer primary signal $P^\wedge_m(n)$ and the energy of input m-th layer secondary signal $A^\wedge_m(n)$, and selects the signal of the higher energy. Then, selecting section 1021-m outputs indicator $F_m$ indicating the selected signal (primary signal or secondary signal) to encoding section 1022-m, decoding section 1023-m and multiplexing section 104 shown in FIG. 3.

In m-th layer primary signal $P^\wedge_m(n)$ and m-th layer secondary signal $A^\wedge_m(n)$ received as input, encoding section 1022-m encodes a signal indicated by indicator $F_m$ received as input from selecting section 1021-m, that is, a signal selected in selecting section 1021-m, to generate m-th layer encoded data $C_m$. To be more specific, encoding section 1022-m encodes m-th layer primary signal $P^\wedge_m(n)$ when the signal indicated by indicator $F_m$ is the primary signal, or encodes m-th layer secondary signal $A^\wedge_m(n)$ when the signal indicated by indicator $F_m$ is the secondary signal. Then, encoding section 1022-m outputs generated m-th layer encoded data $C_m$ to decoding section 1023-m and multiplexing section 104 shown in FIG. 3.

Decoding section 1023-m specifies encoded data $C_m$ received as input from encoding section 1022-m based on indicator $F_m$ received as input from selecting section 1021-m and generates an m-th layer decoded signal by decoding encoded data $C_m$. Here, decoding section 1023-m makes a decoded signal of the other signal than the signal indicated by indicator $F_m$ "0." Then, in m-th layer decoded signals generated, decoding section 1023-m outputs the decoded signal of the primary signal to subtractor 1024-m and the decoded signal of the secondary signal to subtractor 1025-m. To be more specific, when the signal indicated by indicator $F_m$ is the primary signal, decoding section 1023-m decodes m-th layer primary signal $P^\wedge_m(n)$ using m-th layer encoded data $C_m$. Then, decoding section 1023-m outputs decoded signal $P_m(n)$ of the primary signal to subtractor 1024-m while outputting "0" to subtractor 1025-m as decoded signal $A_m(n)$ of the secondary signal. By contrast with this, when the signal indicated by indicator $F_m$ is the secondary signal, decoding section 1023-m decodes m-th layer secondary signal $A^\wedge_m(n)$ using encoded data $C_m$. Then, decoding section 1023-m outputs decoded signal $A_m(n)$ of the secondary signal to subtractor 1025-m while outputting "0" to subtractor 1024-m as decoded signal $P_m(n)$ of the primary signal.

Subtractor 1024-m generates, as (m+1)-th layer primary signal $P^\wedge_{m+1}(n)$, a coding residual signal obtained by subtracting decoded signal $P_m(n)$ of the primary signal received as input from decoding section 1023-m, from m-th layer primary signal $P^\wedge_m(n)$ of an input signal. Then, subtractor 1024-m outputs (m+1)-th layer primary signal $P^\wedge_{m+1}(n)$ to adaptive residue encoding section 102-(m+1) supporting the (m+1)-th layer, which is the next coding layer.

Subtractor 1025-m generates, as (m+1)-th layer secondary signal $A^\wedge_{m+1}(n)$, a coding residual signal obtained by subtracting decoded signal $A_m(n)$ of the secondary signal received as input from decoding section 1023-m, from m-th layer secondary signal $A^\wedge_m(n)$ of an input signal. Then, subtractor 1025-m outputs (m+1)-th layer secondary signal $A^\wedge_m+_1(n)$ to adaptive residue encoding section 102-(m+1).

For example, when the primary signal is selected in selecting section 1021-m, subtractor 1024-m generates, as (m+1)-th layer primary signal $P^\wedge_{m+1}(n)$, a coding residual signal obtained by subtracting a decoded signal of encoded data $C_m$ from m-th layer primary signal $P^\wedge_m(n)$. Also, subtractor 1025-m generates m-th layer secondary signal $A^\wedge_m(n)$ as (m+1)-th layer secondary signal $A^{\wedge}_{m+1}(n)$. In contrast, when the secondary signal is selected in selecting section 1021-m, subtractor 1025-m generates, as (m+1)-th layer secondary signal $A^{\wedge}_{m+1}(n)$, a coding residual signal obtained by subtracting a decoded signal of encoded data $C_m$ from m-th layer secondary signal $A^{\wedge}_m(n)$. Also, subtractor 1024-m generates m-th layer primary signal $P^{\wedge}_m(n)$ as (m+1)-th layer primary signal $P^{\wedge}_{m+1}(n)$.

Figure 6:
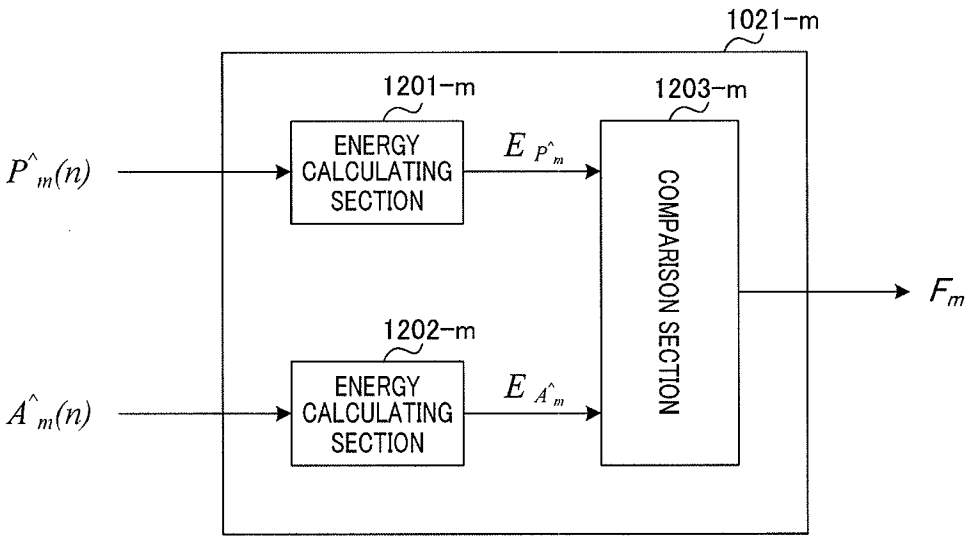
FIG. 6 is a block diagram showing a configuration inside a selecting section according to Embodiment 1 of the present invention.

Next, the configuration inside selecting section 1021-m will be explained using FIG. 6. FIG. 6 is a block diagram showing the configuration inside selecting section 1021m.

In selecting section 1021-m shown in FIG. 6, energy calculating section 1201-m calculates energy $E_{P^{\wedge}m}$ of m-th layer primary signal $P^{\wedge}_m(n)$ according to equation 3. Then, energy calculating section 1201-m outputs calculated energy $E_{P^{\wedge}m}$ to comparison section 1203-m.

(Equation 3)

$$E_{\hat{P}_m} = \sum_{n=0}^{NB-1} \hat{P}_m(n)^2 \quad [3]$$

Energy calculating section 1202-m calculates energy $E_{A^{\wedge}m}$, of m-th layer secondary signal $A^{\wedge}_m(n)$ according to equation 4. Then, energy calculating section 1202-m outputs calculated energy $E_{A^{\wedge}m}$ to comparison section 1203-m.

(Equation 4)

$$E_{\hat{A}_m} = \sum_{n=0}^{NB-1} \hat{A}_m(n)^2 \quad [4]$$

Comparison section 1203-m compares energy $E_{P^{\wedge}m}$ received as input from energy calculating section 1201-m and energy $E_{A^{\wedge}m}$ received as input from energy calculating section 1202-m. Then, comparison section 1203-m selects the signal of the higher energy (i.e. primary signal or secondary signal) as a signal to encode in the m-th layer. For example, when energy $E_{P^{\wedge}m}$ is equal to or higher than energy $E_{A^{\wedge}m}$, comparison section 1203-m selects the primary signal (i.e. m-th layer primary signal $P^{\wedge}_m(n)$) as the signal to encode in the m-th layer. By contrast, when energy $E_{P^{\wedge}m}$ is lower than energy $E_{A^{\wedge}m}$, comparison section 1203-m selects the secondary signal (i.e. m-th layer secondary signal $A^{\wedge}_m(n)$) as the signal to encode in the m-th layer. Then, comparison section 1203-m generates indicator $F_m$ indicating the selected signal, that is, the signal (primary signal or secondary signal) encoded in the m-th layer.

As described above, encoding apparatus 100 according to the present embodiment encodes only one of the primary signal and the secondary signal every coding layer. Therefore, the amount of information (the number of bits) of an indicator, which is bit allocation information in each coding layer, requires only one bit to distinguish between the primary signal and the secondary signal.

Also, selecting section 1021-m described above may calculate the energy of a primary signal and secondary signal in the logarithmic domain. Also, selecting section 1021-m may use left signal L(n) and right signal R(n) to calculate the energy of the primary signal and the secondary signal, and, for example, may use the energy of left signal L(n) and right signal R(n). Also, selecting section 1021-m may calculate the energy of the primary signal and the secondary signal taking into account masking.

Next, decoding apparatus 200 shown in FIG. 7 will be explained. Decoding section 200 receives bit streams transmitted from encoding apparatus 100 via the communication path. In decoding apparatus 200 shown in FIG. 7, demultiplexing section 201 demultiplexes the bit streams into encoded data $C_m$ and indicator $F_m$ for respective coding layers of the first layer to the M-th layer, and quantized codes of PCA transformation parameters. Then, demultiplexing section 201 outputs encoded data $C_m$ and indicator $F_m$ for each coding layer to decoding sections 202-1 to 202-M respectively supporting the first layer to the M-th layer. Further, demultiplexing section 201 outputs the quantized codes of PCA transformation parameters to dequantizing section 205.

Decoding sections 202-1 to 202-M each decodes encoded data received as input from demultiplexing section 201, based on indicator $F_m$ received as input from demultiplexing section 201. For example, when the signal indicated by indicator $F_m$ is the primary signal, decoding section 202-m decodes the primary signal using encoded data $C_m$. Then, decoding section 202-m outputs decoded signal $P_m(n)$ to adder 203. In contrast, when the signal indicated b indicator $F_m$ is the secondary signal, decoding section 202-m decodes the secondary signal using encoded data $C_m$. Then, decoding section 202-m outputs decoded signal $A_m(n)$ to adder 204. Also, decoding section 202-m outputs "0" to adder 203 or adder 204 as a decoded signal of the other signal than the signal indicated by indicator $F_m$.

Adder 203 adds decoded signals $P_m(n)$ received as input from decoding sections 202-1 to 202-M. Then, adder 203 outputs decoded primary signal P(n), which is obtained by adding decoded signals of all coding layers (the first layer to the M-th layer), to inverse PCA transformation section 206.

Adder 204 adds decoded signals $A_m(n)$ received as input from decoding sections 202-1 to 202-M. Then, adder 204 outputs decoded secondary signal A(n), which is obtained by adding decoded signals of all coding layers (the first layer to the M-th layer), to inverse PCA transformation section 206.

Also, depending on, for example, the communication path condition, a case is possible where part of bit streams is discarded. For example, if bit streams include only encoded data up to the m-th layer (m<M), decoding sections up to the first to M-th layers perform operations and adders 203 and 204 supporting these coding layers perform operations to obtain decoded primary signal P(n) and decoded secondary signal A(n), and these decoded primary signal P(n) and decoded secondary signal A(n) are outputted to inverse PCA transformation section 206.

Dequantizing section 205 dequantizes quantized codes received as input from demultiplexing section 201 and outputs resulting PCA transformation parameters $v_1$ and $v_2$ to inverse PCA transformation section 206.

Inverse PCA transformation section 206 receives decoded primary signal P(n) as input from adder 203, receives decoded secondary signal A(n) as input from adder 204 and receives PCA transformation parameters $v_1$ and $v_2$ as input from dequantizing section 205. According to equation 2, inverse PCA transformation section 206 applies inverse PCA transformation to decoded primary signal P(n) and decoded secondary signal A(n) using PCA transformation parameters $v_1$ and $v_2$, and obtains left signal L(n) and right signal R(n) of a stereo signal.

Thus, according to the present embodiment, encoding apparatus 100 (FIG. 3) selects the signal of the higher energy between the primary signal and the secondary signal in each coding layer, as the coding target. As a result, the signal encoded in each coding layer is only one of the primary signal and the secondary signal, and, consequently, the amount of information (the number of bits) of an indicator indicating an encoded signal (i.e. a signal allocated to a bit sequence) requires only one bit. That is, encoding apparatus 100 can minimize bit allocation information of encoded data in each coding layer.

Also, in scalable coding, coding residual signals in a lower coding layer are received as the input primary signal and secondary signal in each coding layer. Consequently, the energy of input signals in each coding layer changes depending on the coding result in a lower coding layer. Therefore, encoding apparatus 100 (FIG. 3) can adaptively select the signal of the higher energy (i.e. the signal of the higher importance) in each coding layer, according to the coding result in a lower coding layer. By this means, decoding apparatus 200 (FIG. 7) can decode stereo signals of high quality.

(Embodiment 2)

Although adaptive residue coding processing is applied to the primary signal and the secondary signal in the first layer of the lowest layer in Embodiment 1, with the present embodiment, band division coding processing is applied to the primary signal in the first layer for further dividing the first layer into layers and performing coding in division frequency band units.

As a method of scalable coding in division frequency band units, studies are underway on, for example, a method of realizing scalable coding by dividing an input signal into a plurality of bands and performing coding in divided band signal units (e.g. see US Patent Application Publication No. 2008/004883, specification), and a method of realizing scalable coding by performing coding in subband units on MDCT coefficients in coding after layer 4 of ITU-T recommendation G.729.1 (i.e. TDAC (Time-Domain Aliasing Cancellation)), and transmitting encoded data preferentially from the subband of the highest energy (see ITU-T recommendation G.729.1 (2006)).

In scalable coding based on band division coding, when an encoded error signal (coding residual signal) of a band signal of the coding target in a lower layer is large, the influence given from the coding residual signal to perceptual decoding quality is larger than the influence given from a band signal of the coding target in a higher layer to perceptual decoding quality.

Therefore, in a coding layer of the band division coding target, the present embodiment adaptively decides whether or not to encode the coding residual signal in a lower layer than each coding layer.

Figure 8:
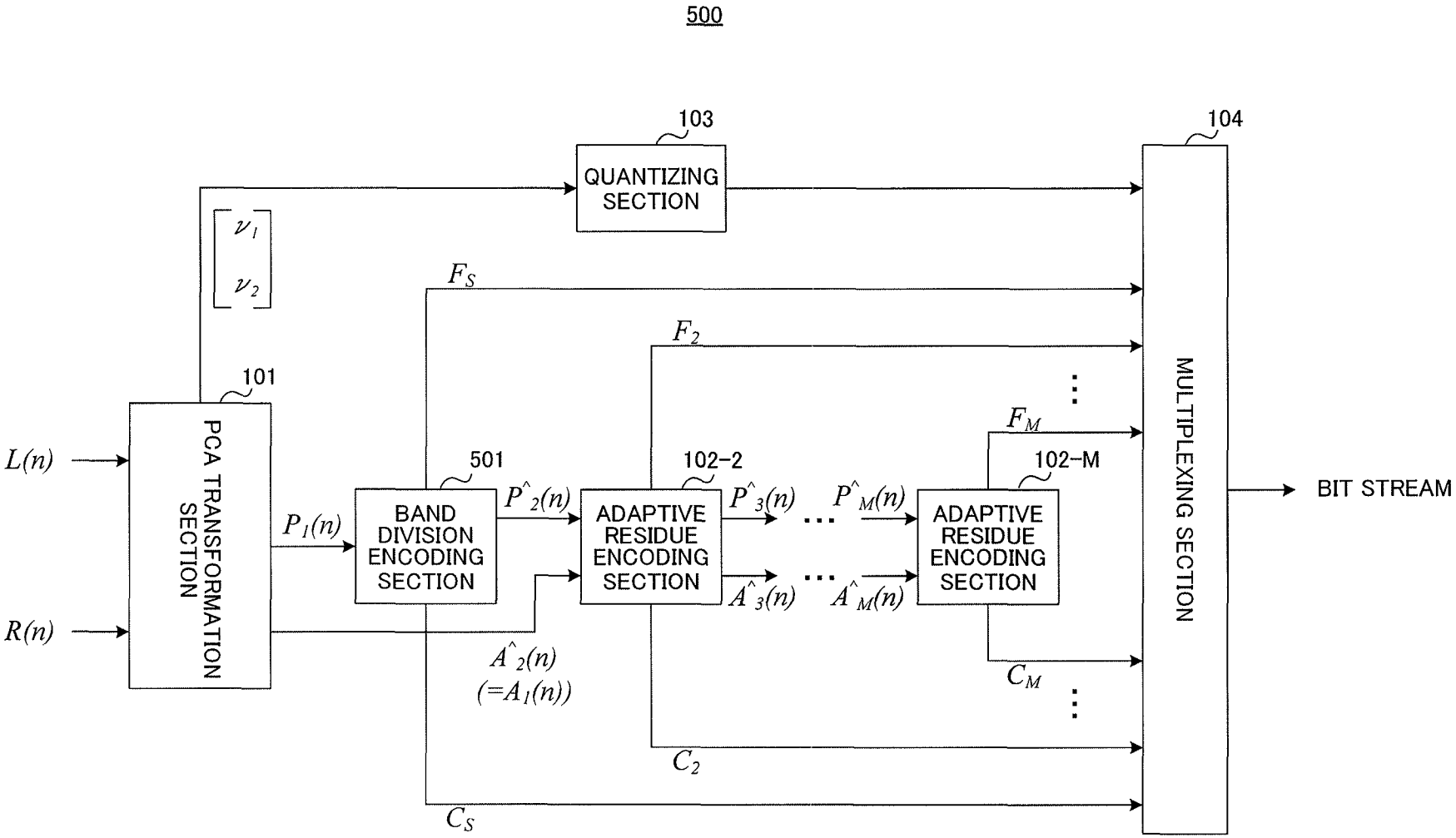
FIG. 8 is a block diagram showing a configuration of an encoding apparatus according to Embodiment 2 of the present invention.

FIG. 8 is a block diagram showing the configuration of an encoding apparatus according to the present embodiment. Also, in FIG. 8, the same components as in encoding apparatus 100 shown in FIG. 3 will be assigned the same reference numerals and their explanation will be omitted.

In encoding apparatus 500 shown in FIG. 8, PCA transformation section 101 outputs first layer primary signal $P_1(n)$ to band division encoding section 501 and outputs first layer secondary signal $A_1(n)$ to adaptive residue encoding section 102-2 as second layer secondary signal $\hat{A}_2(n)$.

Band division encoding section 501 divides primary signal $P_1(n)$ received as input from PCA transformation section 101 into a plurality of bands, and encodes divided band unit signals in a layered manner. Here, when band division encoding section 501 performs coding from the first layer to the L-th layer (L is a natural number equal to or greater than 2), adaptive residue encoding sections 102-2 to 102-M perform coding after the (L+1)-th layer in order. Then, band division encoding section 501 outputs encoded data $C_S$ including encoded data generated in each of coding layers up to the L-th layer, and indicator $F_S$ including the decision result generated in each of bands (subbands) dividing the first layer coding target band, to multiplexing section 104. Further, band division encoding section 501 outputs a coding residual signal encoded to adaptive residue encoding section 102-2 as input signal $\hat{P}_2(n)$ of adaptive residue encoding section 102-2.

Figure 9:
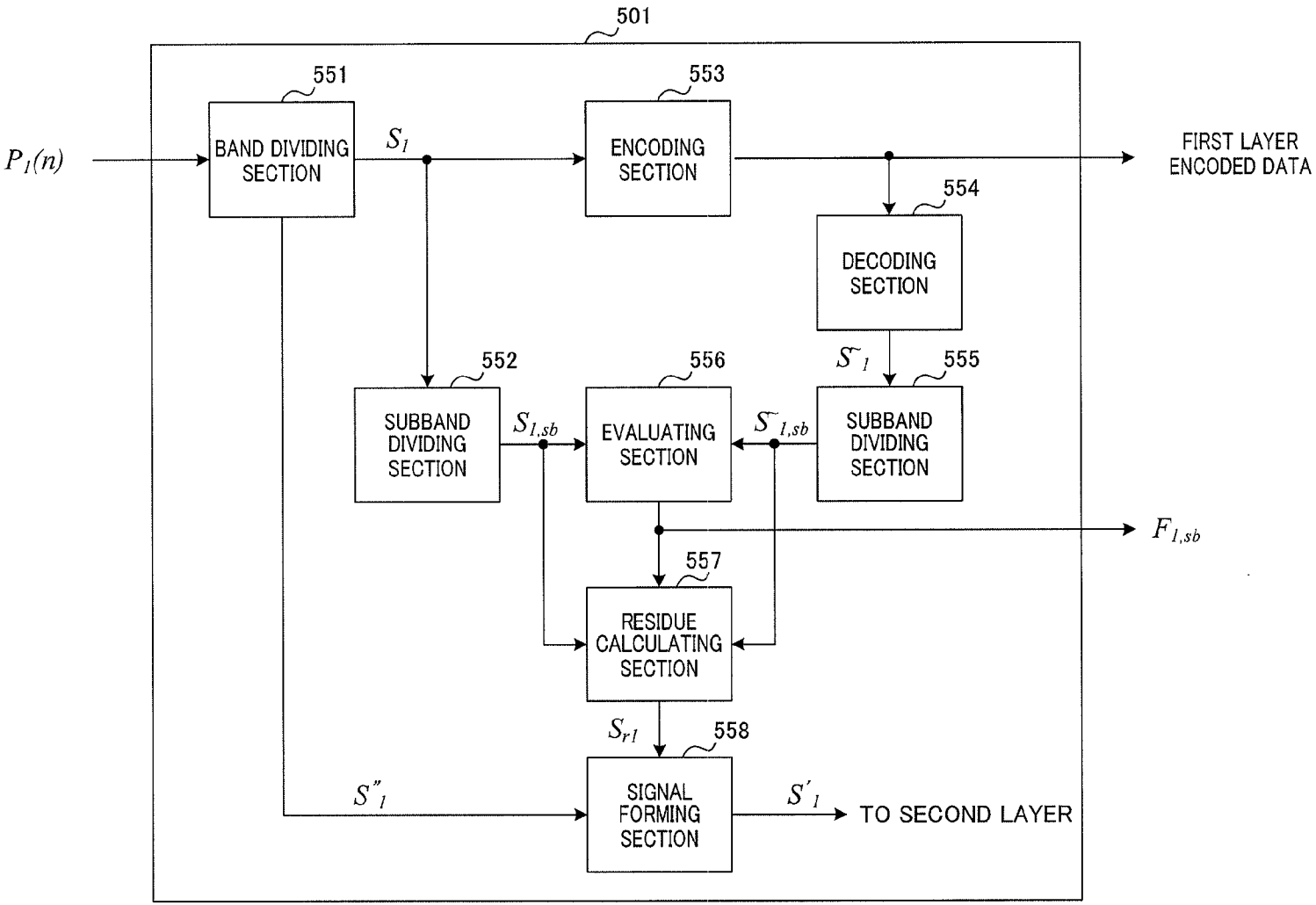
FIG. 9 is a block diagram showing a configuration inside a band division encoding section according to Embodiment 2 of the present invention.

FIG. 9 is a block diagram showing the components related to input signal forming processing for the components related to first layer coding processing and second layer coding processing, in the configuration inside band division encoding section 501 shown in FIG. 8.

In band division encoding section 501 shown in FIG. 9, band dividing section 551 divides first layer primary signal $P_1(n)$ received as input from PCA transformation section 101 (FIG. 8), into first band signal $S_1$, which is the first band signal of the first layer coding target, and signal $S''_1$ different from first band signal $S_1$. For example, band dividing section 551 uses the signal from a lower band to a predetermined frequency band in the frequency band of first layer primary signal $P_1(n)$, as first band signal $S_1$. Then, band dividing section 551 outputs first band signal $S_1$ to subband dividing section 552 and encoding section 553, and outputs signal $S''_1$ different from the first band signal, to signal forming section 558.

Subband dividing section 552 divides first band signal $S_1$ received as input from band dividing section 551, into a plurality of subband signals $S_{1,sb}$ (sb=1, 2, . . . , Nsb, Nsb, which represents the number of subband divisions). Then, subband dividing section 552 outputs divided subband signals $S_{1,sb}$ to evaluating section 556 and residue calculating section 557.

Encoding section 553 encodes first band signal $S_1$ received as input from band dividing section 551 at a coding bit rate set in advance, and generates first layer encoded data. Then, encoding section 553 outputs generated first layer encoded data to decoding section 554 and multiplexing section 104 (FIG. 8).

Decoding section 554 decodes the first layer encoded data received as input from encoding section 553 and generates first layer decoded signal $S_1$. Then, decoding section 554 outputs generated first layer decoded signal $S_1$ to subband dividing section 555.

Similar to subband dividing section 552, subband dividing section 555 divides first layer decoded signal $S_1$ received as input from decoding section 554, into a plurality of subband signals $S_{1,sb}$. Then, subband dividing section 555 outputs divided subband signals $S_{1,sb}$ to evaluating section 556 and residue calculating section 557.

Evaluating section 556 decides whether or not the residue energy in each subband is lower than a predetermined threshold, using subband signals $S_{1,sb}$ received as input from subband dividing section 552 and subband signals $S_{1,sb}$ received as input from subband dividing section 555. To be more specific, first, evaluating section 556 calculates the evaluation value related to coding performance in each subband of the first layer, using subband signals $S_{1,sb}$ and subband signals $S_{1,sb}$. For example, evaluating section 556 uses the SNR (Signal to Noise Ratio) for the coding residual signal in each subband, as an evaluation value. To be more specific, evaluating section 556 calculates $SNR_{sb}$ in the sb-th subband according to equation 5. Here, assume that the number of samples of a subband signal in the sb-th subband is $P_{1,sb}$.

(Equation 5)

$$SNR_{sb} = 10\log\left(\frac{\sum_{j=0}^{P_{1,sb}-1} S_{1,sb}(j)^2}{\sum_{j=0}^{P_{1,sb}-1} \left(S_{1,sb}(j) - \tilde{S}_{1,sb}(j)\right)^2}\right) \quad [5]$$

Further, evaluating section 556 decides whether or not the residue energy is lower than a predetermined threshold, based on the calculated evaluation value (SNR) related to coding performance in each subband. To be more specific, evaluating section 556 compares $SNR_{sb}$ of each subband and predetermined threshold $SNR_{thr}$, and generates following decision result $F_{1,sb}$ in the following sb-th subband.

$F_{1,sb}=1$ if $SNR_{sb}<SNR_{thr}$ $F_{1,sb}=0$ else

That is, evaluating section 556 provides "1" as decision result $F_{1,sb}$ when the evaluation value (SNR) in each subband is lower than a predetermined threshold (i.e. when the residue energy is higher than a predetermined threshold), or provides "0" as decision result $F_{1,sb}$ when the evaluation value (SNR) is equal to or higher than a predetermined threshold (i.e. when the residue energy is equal to or lower than a predetermined threshold). Here, evaluating section 556 may set $SNR_{thr}$ in advance, set $SNR_{thr}$ based on the characteristic of the input signal, or set $SNR_{thr}$ every subband. Then, evaluating section 556 outputs decision result $F_{1,sb}$ in each subband to residue calculating section 557 and multiplexing section 104 (FIG. 8).

Residue calculating section 557 calculates the coding residue signal in each subband based on decision result $F_{1,sb}$ received as input from evaluating section 556. To be more specific, in the sb-th subband in which decision result $F_{1,sb}$ is "1," residue calculating section 557 calculates a coding residual signal in the sb-th subband by subtracting subband signals $S_{1,sb}$, received as input from subband dividing section 555, from subband signals $S_{1,sb}$ received as input from subband dividing section 552. By contrast, in the sb-th subband in which decision result $F_{1,sb}$ is "0," residue calculating section 557 does not calculate a coding residual signal. Then, residue calculating section 557 outputs coding residual signal $S_{r1}$ of the entire first band including a coding residual signal only in subbands in which decision result $F_{1,sb}$ is "1," to signal forming section 558.

Signal forming section 558 forms signal $S'_1$ by adding coding residual signal $S_{r1}$ received as input from residue calculating section 557 and signal $S''_1$ received as input from band dividing section 551. That is, in the frequency band of first layer primary signal $P_1(n)$, signal $S'_1$ has coding residual signal $S_{r1}$ in the first band and signal $S''_1$ in the frequency band different from the first band. Then, signal forming section 558 outputs generated signal $S'_1$ to components (not shown) related to second layer coding processing.

Also, band division encoding section 501 uses signal $S'_1$ outputted from signal forming section 558, as an input signal to the second layer. Then, in the second layer, similar to the first layer, band division encoding section 501 divides the input signal into a second band signal of the second layer coding target and a signal different from the second band signal, and encodes the second band signal at a coding bit rate set in advance. Also, band division encoding section 501 uses the signal different from the second band signal, as an input signal in the third layer. Here, band division encoding section 501 uses a frequency band including part of the first band, as the second band. Therefore, band division encoding section 501 preferentially encodes a frequency band signal corresponding to part of the first band in the second band signal. To be more specific, band division encoding section 501 preferentially encodes coding residual signals in part or all of subbands in which subband decision result $F_{1,sb}$ is "1." The same applies to a third layer or later. Then, band division encoding section 501 outputs, to multiplexing section 104, encoded data $C_S$ including encoded data in all coding layers and indicator $F_S$ including decision result $F_{1,sb}$ in each subband of the first band.

Figure 10:
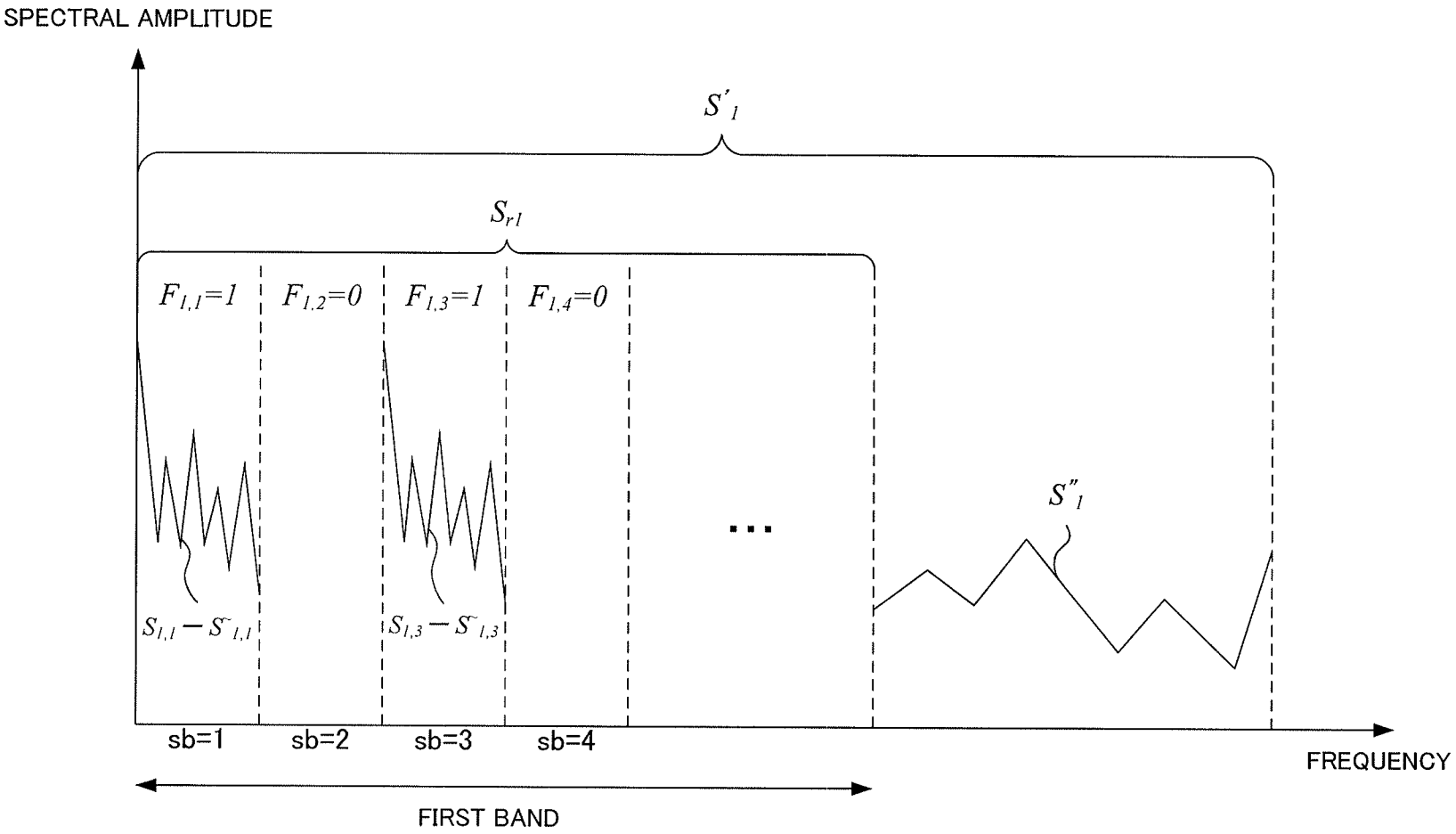
FIG. 10 shows a signal formed in a band division encoding section according to Embodiment 2 of the present invention.

Next, signal $S'_1$ formed in signal forming section 558 is shown in FIG. 10. As shown in FIG. 10, in the first band of the first layer coding target, a coding layer residual signal is present only in subbands in which decision result $F_{1,sb}$ is "1." For example, as shown in FIG. 10, a coding residual signal ($S_{1,1}$-$S_{1,1}$) is present in the first subband (sb=1), in which decision result $F_{1,1}$ is "1," and a coding residual signal ($S_{1,3}$-$S_{1,3}$) is present in a third subband (sb=3), in which decision result $F_{1,3}$ is "1." In contrast, a coding residual signal is not present in a second subband (sb=2), in which decision result $F_{1,2}$ is "0," and in a fourth subband (sb=4) in which decision result $F_{1,4}$ is "0." Also, in the band different from the first layer coding target, signal $S''_1$ of the frequency band different from the first band in first layer primary signal $P_1(n)$, is present as is.

By this means, among subbands of the first band, band division encoding section 501 outputs coding residual signals of subbands in which the residue energy is higher than a threshold, to a higher layer as an input signal. Therefore, among coding residual signals obtained in a lower layer, band division encoding section 501 can adaptively select only signals of higher residue energy (i.e. signals of higher importance) as coding residual signals to encode in a higher layer.

Figure 11:
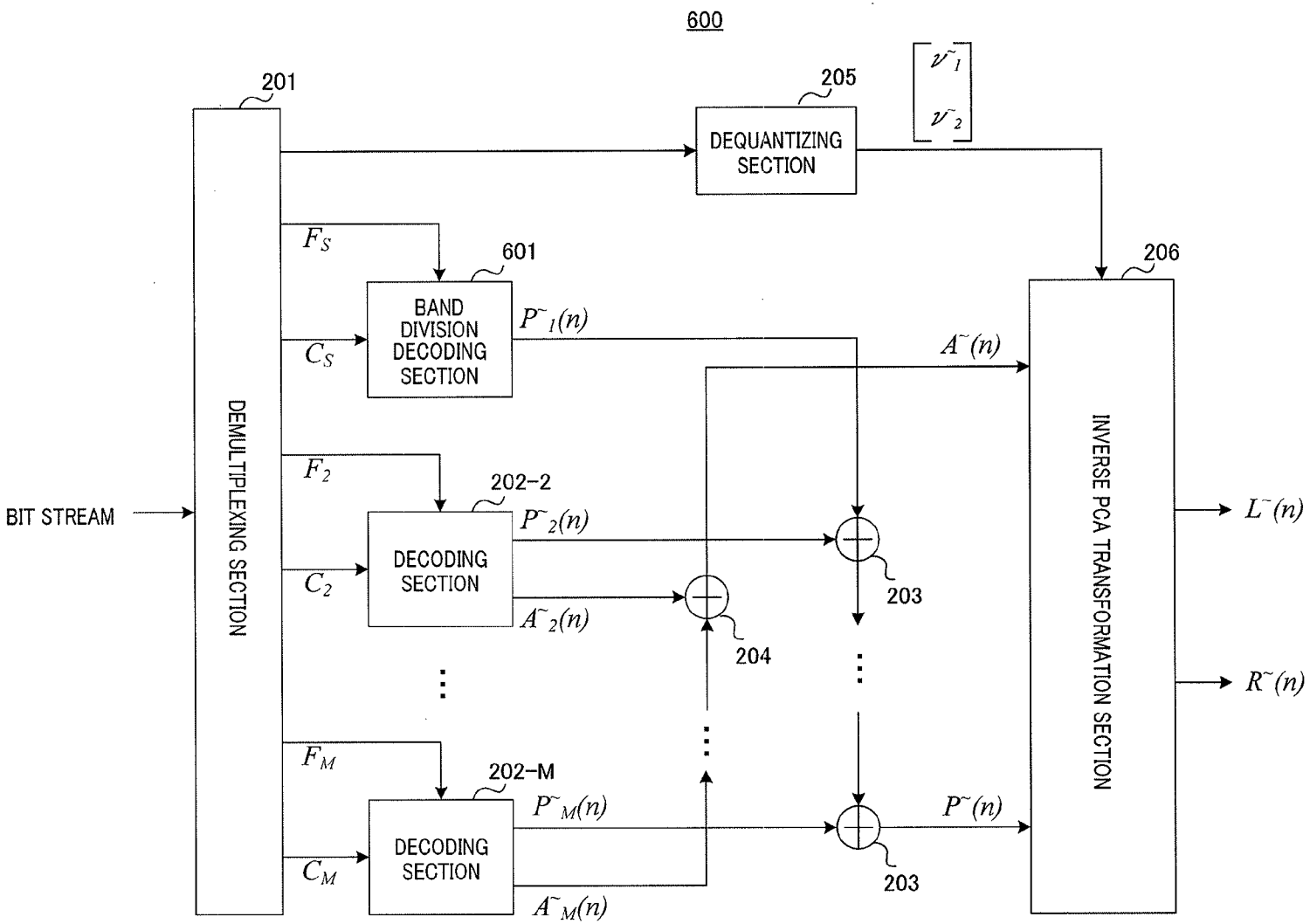
FIG. 11 is a block diagram showing a configuration of a decoding apparatus according to Embodiment 2 of the present invention.

Next, the decoding apparatus according to the present embodiment will be explained. FIG. 11 is a block diagram showing the configuration of decoding apparatus 600. Here, in FIG. 11, the same components as in decoding apparatus 200 shown in FIG. 7 will be assigned the same reference numerals and their explanation will be omitted.

In decoding apparatus 600 shown in FIG. 11, band division decoding section 601 receives as input encoded data $C_S$ including encoded data of each coding layer generated in band division encoding section 501 of encoding apparatus 500, and indicator $F_S$ including decision results $F_{1,sb}$ in a plurality of subbands of the first layer. Band division decoding section 601 decodes encoded data $C_s$ based on decision results $F_{1,sb}$. To be more specific, band division decoding section 601 decodes encoded data of each coding layer received as input from demultiplexing section 201, adds generated decoded signals and decoded signals generated in a higher layer, and thereby generates the decoded signal of each coding layer. Then, as decoded signal $P_1(n)$, band division decoding section 601 outputs, to adder 203, a decoded signal in the first layer, which is the lowest layer among coding layers to which band division encoding processing is applied.

Figure 12:
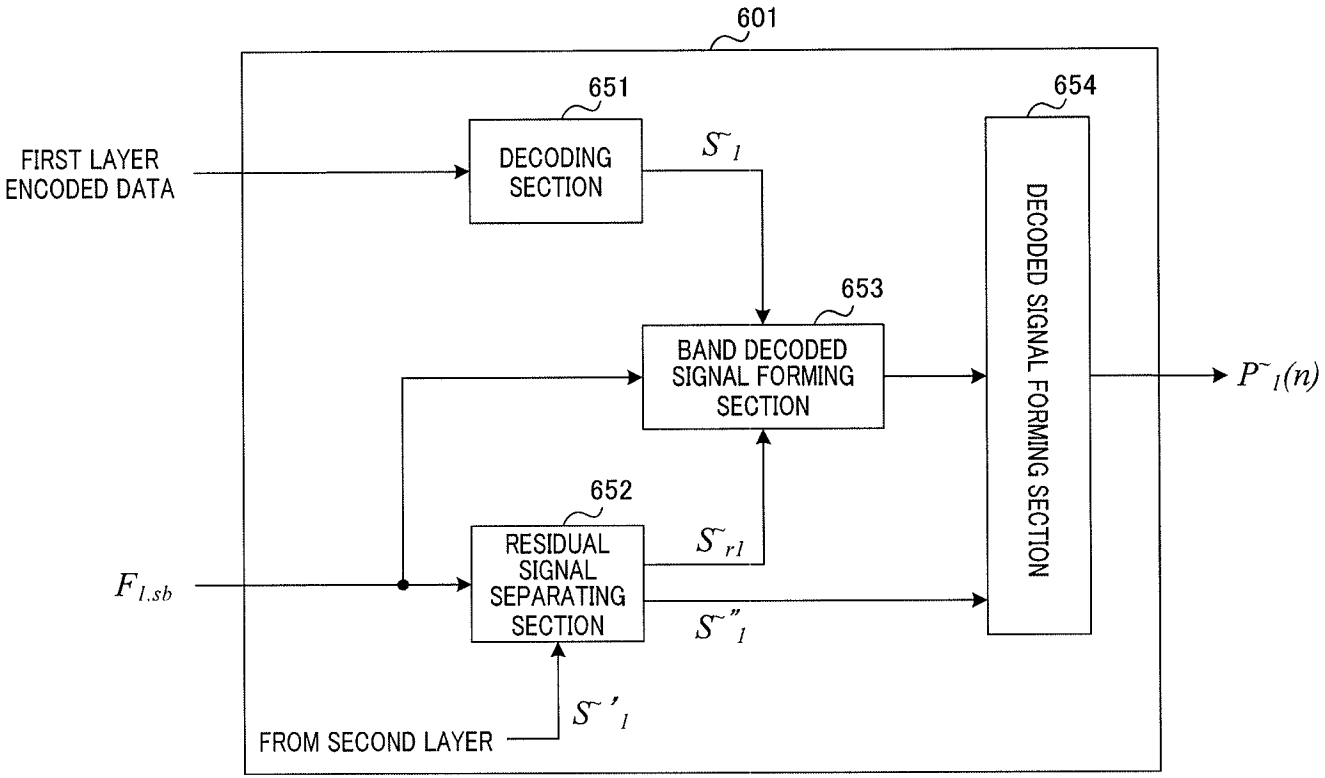
FIG. 12 is a block diagram showing a configuration inside a band division decoding section according to Embodiment 2 of the present invention.

FIG. 12 is a block diagram showing the components related to decoding processing of generating decoded signal $P_1(n)$ in the first layer of the lowest layer, using second layer decoded signal $S'_1$, in the configuration inside band division decoding section 601 shown in FIG. 11.

In band division decoding section 601 shown in FIG. 12, decoding section 651 decodes first layer encoded data included in encoded data $C_S$ received as input from demultiplexing section 201 (FIG. 11). Then, decoding section 651 outputs first layer decoded signal $S_1$ to band decoded signal forming section 653.

Based on decision result $F_{1,sb}$ received as input from demultiplexing section 201, residual signal separating section 652 separates second layer decoded signal $S'_1$ received as input from components (not shown) related to second layer decoding processing (i.e. a signal decoded in the second layer to the L-th layer), to decoded residual signal $S_{r1}$ of the first band and decoded signal $S''_1$ of the different frequency band from the first band. Then, residual signal separating section 652 outputs decoded residual signal $S_{r1}$ of the first band to band decoded signal forming section 653 and decoded signal $S''_1$ of the different frequency band from the first band, to decoded signal forming section 654.

Based on decision result $F_{1,sb}$ received as input from demultiplexing section 201, band decoded signal forming section 653 forms the first band decoded signal by adding decoded signal $S_1$ received as input from decoding section 651 and decoded residual signal $S_{r1}$ received as input from residual signal separating section 652. To be more specific, band decoded signal forming section 653 adds decoded signal $S_1$ and decoded signals of subbands in which decision result $F_{1,sb}$ is "1" in decoded residual signal $S_{r1}$. Then, band decoded signal forming section 653 outputs a formed first band decoded signal to decoded signal forming section 654.

Decoded signal forming section 654 forms decoded signal $P_1(n)$ using the first band decoded signal received as input from band decoded signal forming section 653 and decoded signal $S''_1$ of the frequency band different from the first band received as input from residual signal separating section 652. Then, decoded signal forming section 654 outputs formed decoded signal $P_1(n)$ to adder 203 (FIG. 11).

Thus, according to the present embodiment, encoding apparatus 500 (FIG. 8) applies scalable coding based on band division coding to primary signal $P_1(n)$ and adaptively selects and encodes a signal of a perceptually important frequency band (lower band in particular) in stereo coding, so that it is possible to reduce coding distortion. Therefore, decoding apparatus 600 (FIG. 11) can improve decoded sound quality.

Also, according to the present embodiment, among subbands of the first band of the first layer coding target, only subbands in which the evaluation value (SNR) is less than a predetermined threshold, that is, only subbands in which the residue energy is higher than a predetermined amount, are used as a coding target signal in a higher layer. That is, only signals of the subbands of higher energy in each coding layer (i.e. signals of the subbands of higher perceptual importance) are received as input in a higher layer. Therefore, in each coding layer in band division encoding section 501, encoding apparatus 500 adaptively encodes signals of higher residue energy (i.e. a signal of higher importance) according to a coding result in a lower layer, so that decoding apparatus 600 (FIG. 11) can generate stereo signals of high quality.

Also, according to the present embodiment, the coding target signal in each coding layer may be a time domain signal or a frequency domain signal (e.g. coefficients after MDCT transform).

Also, a case has been described above with the present embodiment where band division coding processing is applied to a lower coding layer than a coding layer to which adaptive residue coding processing is applied. However, according to the present invention, a coding layer to which band division coding processing is applied is not limited to a lower coding layer than a coding layer to which adaptive residue coding processing is applied. For example, an encoding apparatus may apply band division coding processing to a coding layer in the middle of a plurality of coding layers to which adaptive residue coding processing is applied.

Also, a case has been described above with the present embodiment where band division coding processing is applied to a PCA-transformed primary signal. However, according to the present invention, a signal to which adaptive division coding processing is applied is not limited to a PCA-transformed primary signal. For example, an encoding apparatus may apply band division coding processing to a coding residual signal in a coding layer in the middle of a plurality of coding layers to which adaptive residue coding processing is applied, or an arbitrary input signal different from a PCA-transformed signal. Also, an encoding apparatus may apply band division coding processing alone, without combining band division coding processing and adaptive residue coding processing.

Also, a case has been described above with the present embodiment where, in a band division encoding section, a frequency band set in advance from a lower band to a predetermined band in an input signal, is used as the coding target frequency band in each coding layer. However, according to the present invention, it is possible to adaptively set, for example, a frequency band based on the characteristic of an input signal as the coding target frequency band in each coding layer.

Also, a case has been described above with the present embodiment where an encoding apparatus determines whether or not to calculate the coding residual signal in each subband of the first band based on decision result $F_{1,sb}$. However, according to the present invention, it is equally possible to calculate coding residual signals in all subbands of the first band, regardless of decision result $F_{1,sb}$.

Embodiments of the present invention have been described above.

Figure 13:
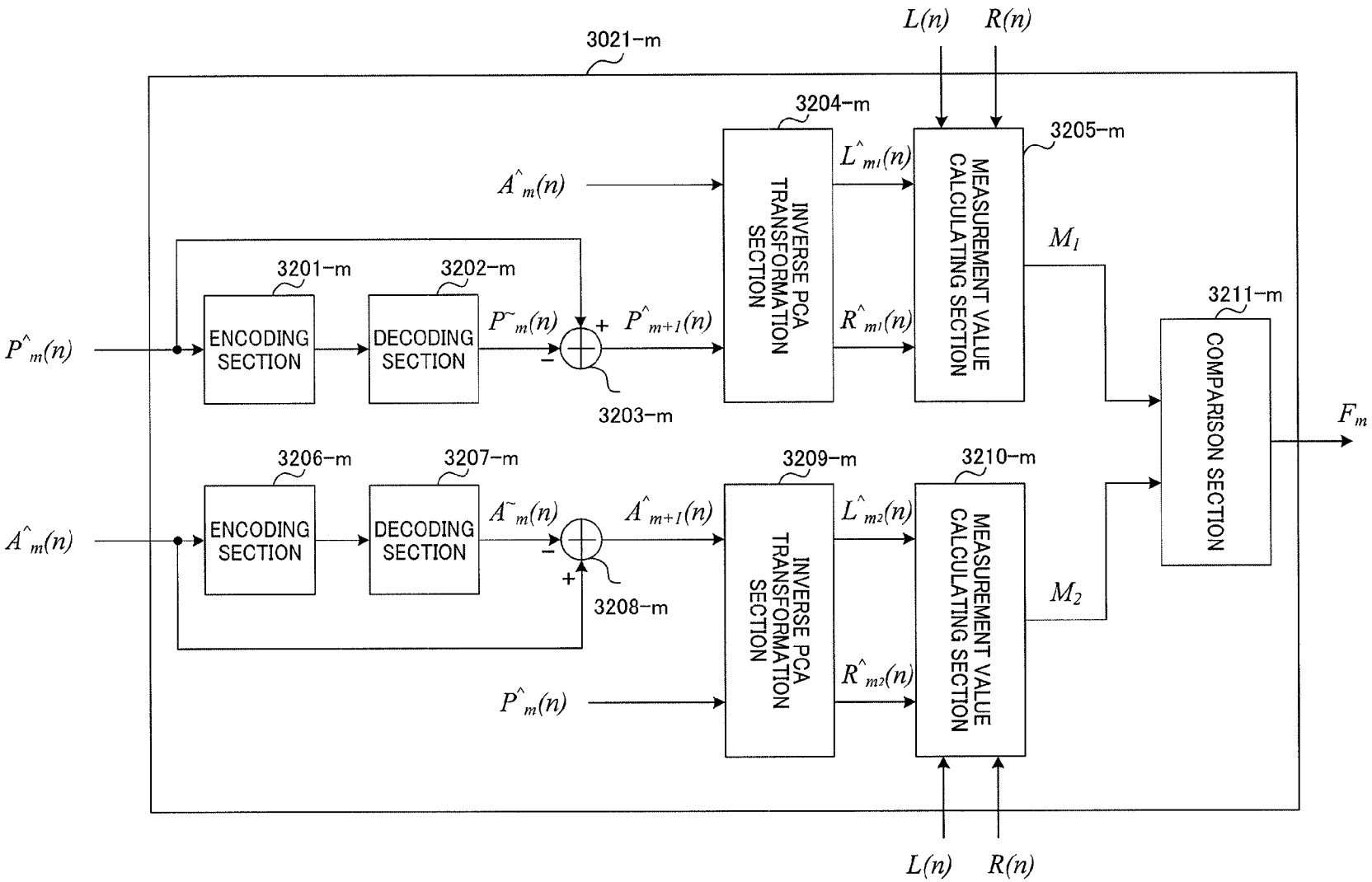
FIG. 13 is a block diagram showing a configuration of a selecting section in a case of performing another selecting processing, according to the present invention.

Also, cases have been described above with embodiments where signal energy is used as an index of signal importance. However, according to the present invention, the signal importance is not limited to the signal energy, and, for example, signal's SNR (Signal to Noise Ratio) may be used. The configuration inside selecting section 3021-m of adaptive residue encoding section 102-m in a case where the SNR is used as an index of signal importance, will be explained using the block diagram of FIG. 13. In selecting section 3021-m shown in FIG. 13, encoding section 3201-m generates encoded data by encoding m-th layer primary signal $\hat{P}_m(n)$, and decoding section 3202-m generates decoded signal $P_m(n)$ of the m-th layer primary signal by decoding encoded data of m-th layer primary signal $\hat{P}_m(n)$. Then, subtractor 3203-m generates (m+1)-th layer primary signal $\hat{P}_{m+1}(n)$ by subtracting decoded signal $P_m(n)$ of the m-th layer primary signal from m-th layer primary signal $\hat{P}_m(n)$. Inverse PCA transformation section 3204-m obtains left signal $\hat{L}_{m1}(n)$ and right signal $\hat{R}_{m1}(n)$ by applying inverse PCA transformation to (m+1)-th layer primary signal $\hat{P}_{m+1}(n)$ and m-th layer secondary signal $\hat{A}_m(n)$. That is, encoding section 3201-m, decoding section 3202-m, subtractor 3203-m and inverse PCA transformation section 3204-m generate output stereo signals (left signal $\hat{L}_{m1}(n)$ and right signal $\hat{R}_{m1}(n)$) in decoding apparatus 200 in a case where m-th layer primary signal $\hat{P}_m(n)$ is encoded (i.e. where selecting section 3021-m selects the primary signal). Then, measurement value calculating section 3205-m calculates quantitative measurement value $M_1$ (i.e. SNR) using left signal $\hat{L}_{m1}(n)$ and right signal $\hat{R}_{m1}(n)$ (equation 6).

(Equation 6)

$$M_1 = SNR_1(L) + SNR_1(R) = 10\log\left(\frac{\sum_{n=0}^{NB-1} L(n)^2}{\sum_{n=0}^{NB-1} \hat{L}_{m_1}(n)^2}\right) + 10\log\left(\frac{\sum_{n=0}^{NB-1} R(n)^2}{\sum_{n=0}^{NB-1} \hat{R}_{m_1}(n)^2}\right) \quad [6]$$

Similarly, encoding section 3206-m, decoding section 3207-m, subtractor 3208-m and inverse PCA transformation section 3209-m generate output stereo signals (left signal $L\hat{}_{m2}(n)$ and right signal $R\hat{}_{m2}(n)$) in decoding apparatus 200 in a case where m-th layer secondary signal $A\hat{}_m(n)$ is encoded (i.e. where selecting section 3021-m selects the secondary signal). Then, measurement value calculating section 3210-m calculates quantitative measurement value $M_2$ (i.e. SNR) using left signal $L\hat{}_{m2}(n)$ and right signal $R\hat{}_{m2}(n)$ (equation 7).

(Equation 7)

$$M_2 = SNR_2(L) + SNR_2(R) = 10\log\left(\frac{\sum_{n=0}^{NB-1} L(n)^2}{\sum_{n=0}^{NB-1} \hat{L}_{m_2}(n)^2}\right) + 10\log\left(\frac{\sum_{n=0}^{NB-1} R(n)^2}{\sum_{n=0}^{NB-1} \hat{R}_{m_2}(n)^2}\right) \quad [7]$$

Comparison section 3211-m compares quantitative measurement value $M_1$ and quantitative measurement value $M_2$, selects the signal of the higher quantitative measurement value (i.e. primary signal or secondary signal) as the signal to be encoded, and outputs indicator $F_m$ to indicate the selected signal. That is, selecting section 3021-m generates an output stereo signal obtained in decoding apparatus 200 upon encoding the primary signal and an output stereo signal obtained in decoding apparatus 200 upon encoding the secondary signal, in selecting section 3021-m. By this means, selecting section 3021-m can calculate the SNR in decoding apparatus 200 as a quantitative measurement value. Therefore, selecting section 3021-m selects the signal of the higher SNR in decoding apparatus 200, so that, similar to the above embodiments, it is possible to minimize the amount of information for reporting bit allocation information and improve the efficiency of coding. Here, the quantitative measurement value to indicate signal importance is not limited to the SNR calculated in equations 6 and 7, and it is equally possible to use, for example, an MNR (Mask to Noise Ratio). For example, when an MNR is used as stereo signal importance, it is possible to obtain the MNR through processing including psychoacoustic modeling of left signal L(n) and right signal R(n) in the stereo signal.

Also, cases have been described above with embodiments where the present invention is applied to time domain stereo signals. However, the present invention is not limited to time domain signals, but is applicable to stereo signals in other domains. For example, it is possible to apply the present invention to stereo signals in the MDCT (Modified Discrete Cosine Transform) domain or LPC (Linear Prediction Coefficient) residual signals obtained by applying an LPC analysis to stereo signals. Also, the present invention is applicable to LPC residual signals in the MDCT domain.

Also, in a case where the encoding apparatus according to the present invention divides an input signal band into a plurality of subbands, the present invention is applicable to subband signals, each of which is the signal of each subband of the input signal. For example, left signal L(n) and right signal R(n) of a stereo signal of an input signal are divided into K subbands to obtain subband signals $L_k(n)$ (k=1 to K) of left signal L(n) and subband signals $R_k(n)$ (k=1 to K) of right signal R(n).

Figure 14:
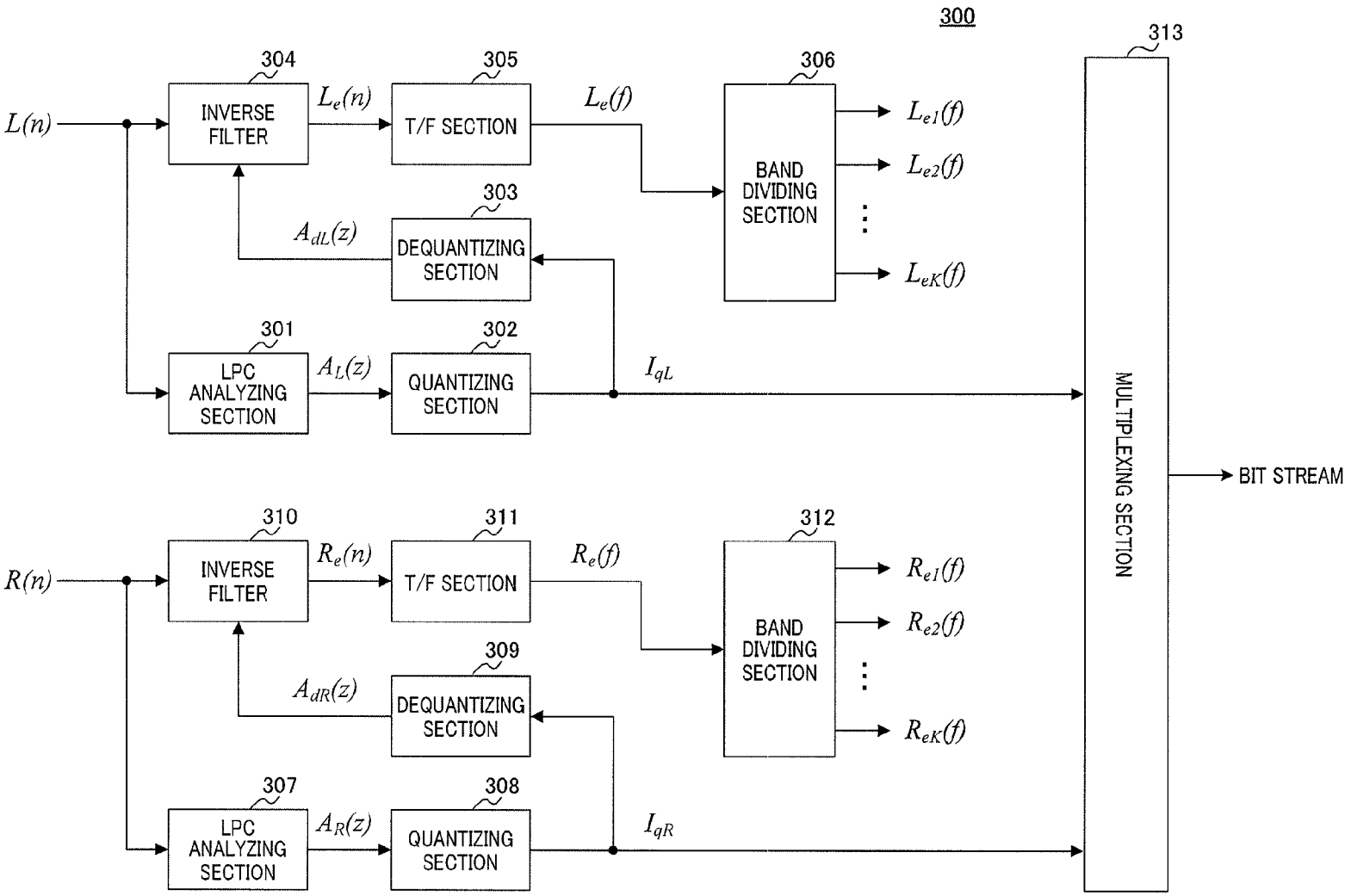
FIG. 14 is a block diagram showing a configuration of an encoding apparatus that performs processing of dividing a signal, which is obtained by applying an MDCT to an LPC residual signal, into a plurality of subbands, according to the present invention.
Figure 15:
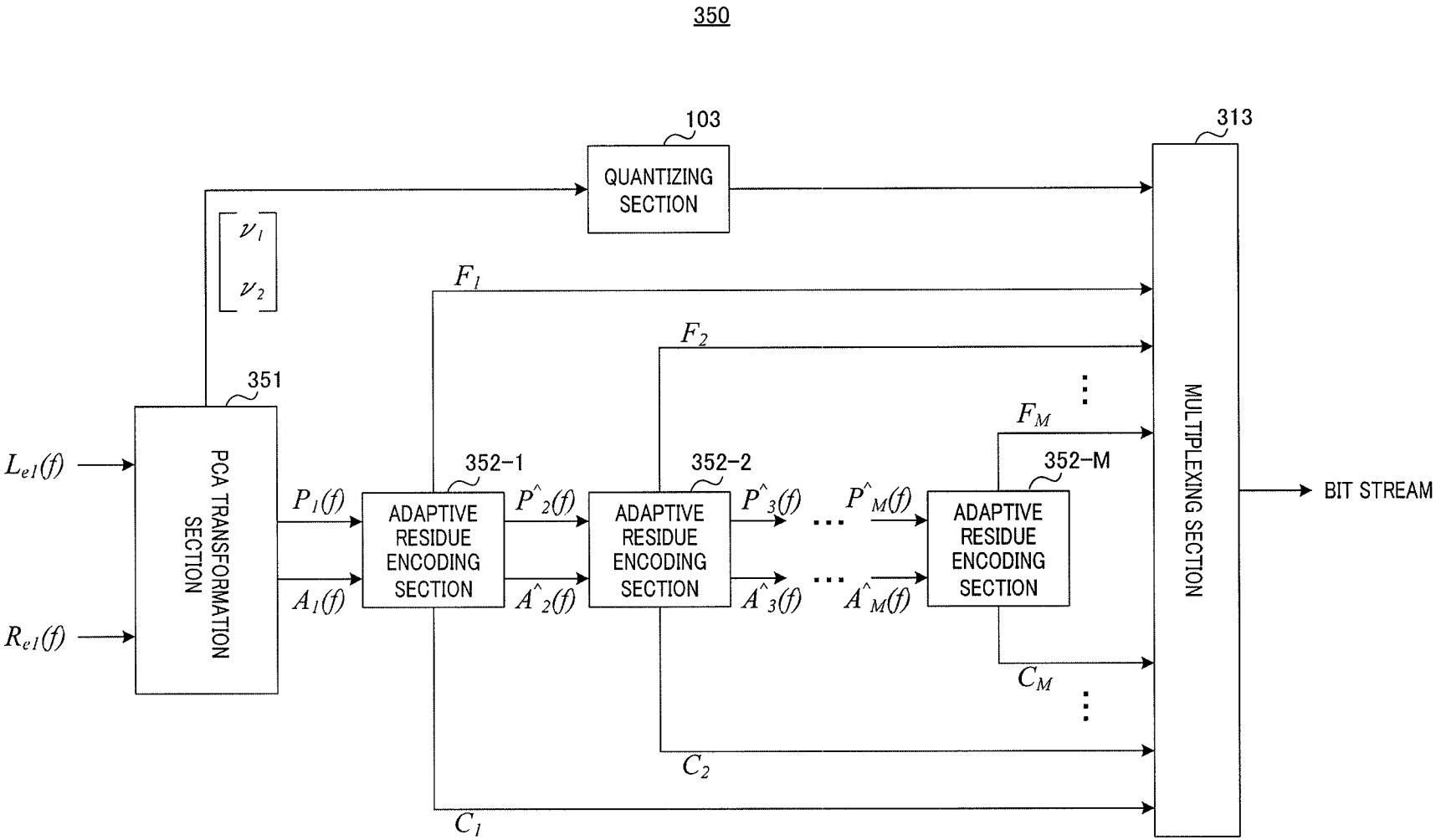
FIG. 15 is a block diagram showing a configuration of another encoding apparatus according to the present invention.
Figure 16:
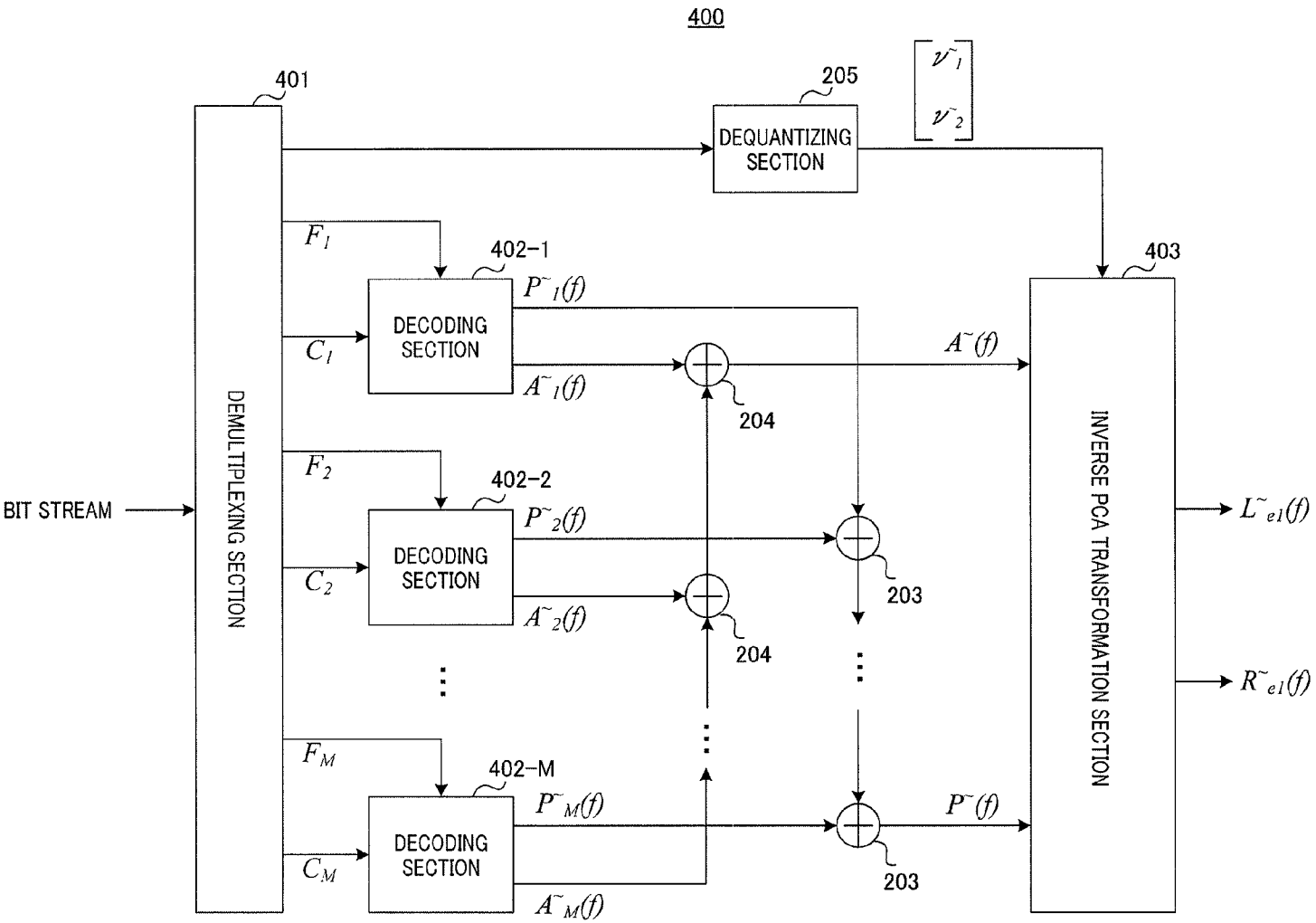
FIG. 16 is a block diagram showing a configuration of another decoding apparatus according to the present invention.
Figure 17:
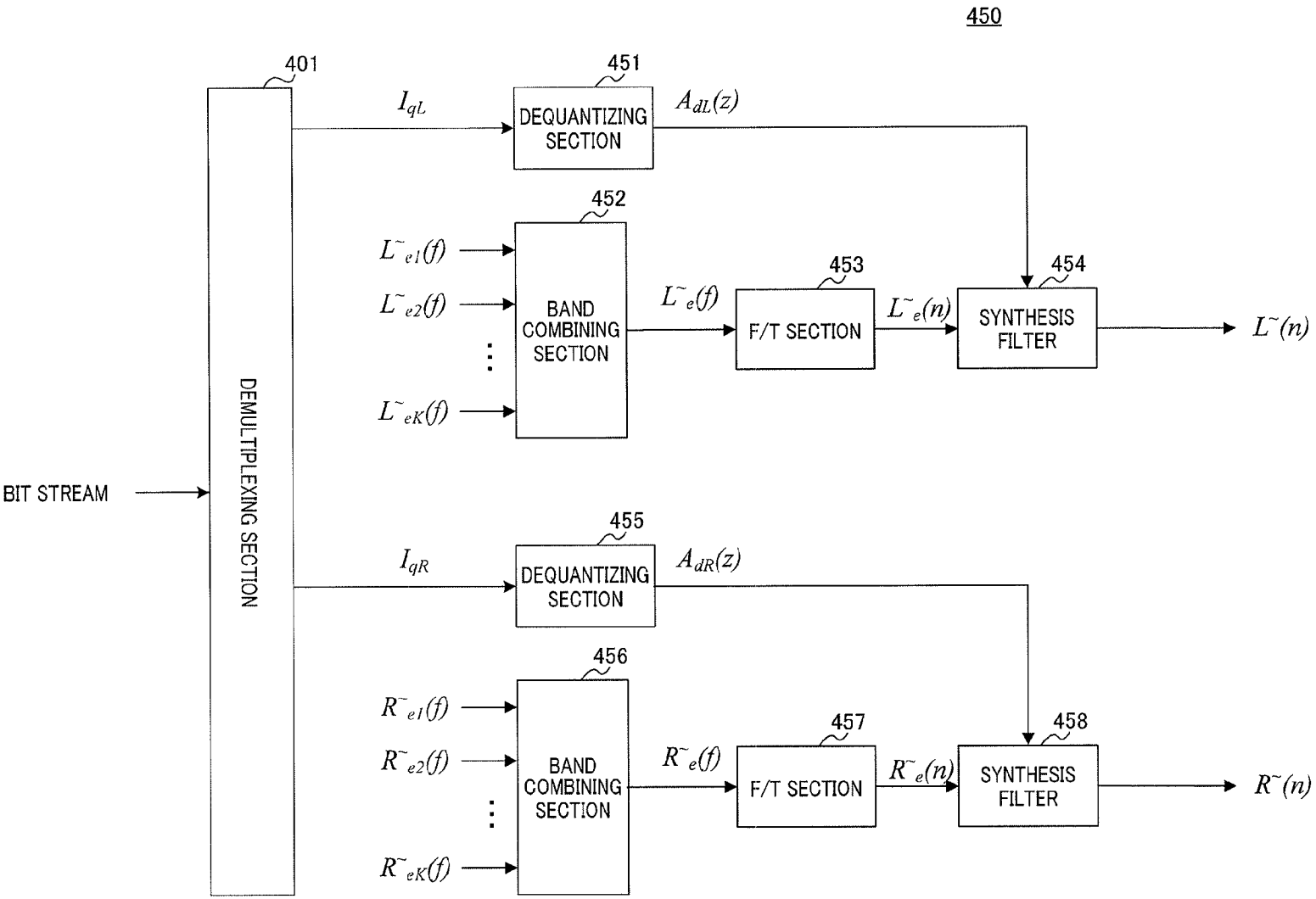
FIG. 17 is a block diagram showing a configuration of a decoding apparatus that performs processing of combining signals divided into a plurality of subbands, according to the present invention.

For example, in a stereo signal, a case will be explained with FIG. 14 to FIG. 17, where an LPC residual signal in the MDCT domain is divided into a plurality of subband signals. Here, FIG. 14 shows configuration 300 in the encoding apparatus, relating to processing of dividing an MDCT-domain LPC residual signal into a plurality of subband signals, and FIG. 15 shows configuration 350 in the encoding apparatus, relating to coding processing according to the present invention. Similarly, FIG. 16 shows configuration 400 in the decoding apparatus, relating to decoding processing according to the present invention, and FIG. 17 shows configuration 450 in the decoding apparatus, relating to processing of generating a stereo signal by combining a plurality of subband signals dividing an MDCT-domain LPC residual signal. Here, in FIG. 14 to FIG. 17, the same components as in encoding apparatus 100 shown in FIG. 3 and decoding apparatus 200 shown in FIG. 7 will be assigned the same reference numerals and their explanation will be omitted.

In FIG. 14, LPC analyzing section 301 performs a linear predictive analysis using left signal L(n) of a stereo signal and obtains LPC parameter (Linear predictive parameter) $A_L(z)$ to indicate the spectral outline of left signal L(n). Quantizing section 302 quantizes LPC parameter $A_L(z)$ and obtains quantized code $I_{qL}$. Dequantizing section 303 dequantizes quantized code $I_{qL}$ of the LPC parameter and obtains decoded LPC parameter $A_{dL}(z)$. Inverse filter 304 applies inverse filtering (LPC inverse filtering) to left signal L(n) using decoded LPC parameter $A_{dL}(z)$, and thereby obtains filtered left signal $L_e(n)$ from which a feature of the spectral outline is removed. T/F section 305 performs an MDCT (i.e. time/frequency domain transform) of inverse-filtered left signal $L_e(n)$ and obtains MDCT-domain (frequency-domain) left signal $L_e(f)$ from time-domain left signal $L_e(n)$. That is, LPC residual signal $L_e(f)$ in the MDCT domain of the left signal is obtained.

Band dividing section 306 divides LPC residual signal $L_e(f)$ in the MDCT domain of the left signal into a plurality of subbands (K subbands in this case), and generates subband signals $L_{e1}(f)$ to $L_{eK}(f)$ of left signal $L_e(f)$.

In contrast, analyzing section 307, quantizing section 308, dequantizing section 309, inverse filter 310, T/F section 311 and band dividing section 312 generate subband signals $R_{e1}(f)$ to $R_{eK}(f)$ of right signal $R_e(f)$, by applying, to right signal R(n), the same sequential processing as in from LPC analyzing section 301 to band dividing section 306.

Here, for example, a case will be explained where the present invention is applied only to subband signal $L_{e1}(f)$ and subband signal $R_{e1}(f)$ among subband signals $L_{e1}(f)$ to $L_{eK}(f)$ of left signal $L_e(f)$ and subband signals $R_{e1}(f)$ and $R_{eK}(f)$ of right signal $R_e(f)$. As shown in FIG. 15, PCA transformation section 351 PCA-transforms subband signal $L_{e1}(f)$ and subband signal $R_{e1}(f)$ and obtains primary signal P(f) and secondary signal A(f) in the MDCT domain. Then, in the same way as in the above embodiments, adaptive residue encoding sections 352-1 to 352-M apply adaptive residue coding processing to primary signal P(f) and secondary signal A(f). Multiplexing section 313 multiplexes encoded data $C_m$ and indicator $F_m$ received as input from adaptive residue encoding sections 352-1 to 352-M and LPC parameter quantized codes $I_{qL}$ and $I_{qR}$ received as input from quantizing section 302 and quantizing section 308.

In contrast, demultiplexing section 401 of the decoding apparatus shown in FIG. 16 outputs encoded data $C_m$ and indicator $F_m$ multiplexed in bit streams, to decoding sections 402-1 to 402-M. Also, demultiplexing section 401 outputs LPC parameter quantized codes $I_{qL}$ and $I_{qR}$ to dequantizing section 451 and dequantizing section 455 shown in FIG. 17. In the same way as in the above embodiments, decoding sections 402-1 to 402-M each decode encoded data and obtain MDCT-domain decoded signal $P_m(f)$ and MDCT-domain decoded signal $A_m(f)$. Inverse PCA transformation section 403 obtains subband signal $L_{e1}$ of the left signal and subband signal $R_{e1}$ of the right signal using decoded primary signal $P_m(f)$ and decoded secondary signal $A_m(f)$. Subband signal $L_{e1}$ of the left signal is outputted to band combining section 452 shown in FIG. 17 and subband signal $R_{e1}$ of the right signal is outputted to band combining section 456 shown in FIG. 17.

Dequantizing section 451 shown in FIG. 17 dequantizes LPC parameter quantized code $I_{qL}$ and obtains LPC parameter $A_{dL}(z)$. Band combining section 452 combines subband signals $L_{e1}(f)$ to $L_{eK}(n)$ of left signal $L_e(f)$ and obtains MDCT-domain left signal $L_e(f)$. F/T section 453 performs an inverse MDCT (i.e. frequency/time domain transform) of MDCT-domain left signal $L_e(f)$ and obtains time-domain left signal $L_e(n)$. Synthesis filter 454 applies a synthesis filter to time-domain left signal $L_e(n)$ using LPC parameter $A_{dL}(z)$ and obtains left signal L(n).

In contrast, dequantizing section 455, band combining section 456, F/T section 457 and synthesis filter 458 generate right signal R(n) by applying the same processing as in dequantizing section 451, band combining section 452, F/T section 453 and synthesis filter 454, to quantized code $I_{qR}$ and subband signals $R_{e1}(f)$ to $R_{eK}(n)$ of right signal $R_e(f)$.

Thus, by transforming an LPC residual signal of a stereo signal into the MDCT domain, dividing the MDCT-domain signal into a plurality of subbands and applying PCA transformation or adaptive residue coding to the divided band signals, it is possible to perform efficient coding suitable to each subband.

Also, cases have been described above with embodiments where, when a stereo signal is PCA-transformed, PCA transformation parameters before quantization (i.e. elements of the co-variance matrix eigenvector calculated from a stereo signal) are used. However, according to the present invention, it is equally possible to use quantized PCA transformation parameters as PCA transformation parameters to use upon PCA transformation.

Also, cases have been described above with embodiments where adaptive residue coding processing is performed in coding layers from the first layer to the M-th layer. However, according to the present invention, it is possible to omit adaptive residue coding processing in the first layer of the lowest layer. For example, the primary signal is more important information than the secondary signal in the first layer, so that the encoding apparatus can omit adaptive residue coding processing in the first layer and always select the primary signal. In this case, the encoding apparatus transmits indicators in the second layer to the M-th layer. That is, the indicator in the first layer needs not be transmitted, so that it is possible to reduce bit allocation information by one bit. Also, a case is possible where the encoding apparatus encodes both the primary signal and the secondary signal in the first layer and the present invention is applied to the second layer or later coding layers.

Also, cases have been described above with embodiments where adaptive residue coding processing is performed in coding layers from the first layer to the M-th layer. However, according to the present invention, for example, it is equally possible to omit adaptive residue coding processing in the first layer of the lowest layer to a predetermined coding layer. For example, in the first layer to the (i−1)-th layer (i is a natural number equal to or greater than 2), the encoding apparatus may omit adaptive residue coding processing and always select the primary signal. That is, the present invention is applicable to the i-th layer to the M-th layer in the encoding apparatus. Also, a case is possible where the encoding apparatus encodes both the primary signal and the secondary signal in the first layer to the (i−1)-th layer and the present invention is applied in the i-th layer to the M-th layer.

Also, cases have been described above with embodiments where adaptive residue coding processing is performed in coding layers from the first layer to the M-th layer. However, the present invention is applicable to at least one arbitrary coding layer among the first layer to the M-th layer.

Also, PCA transformation may be referred to as KLT (Karhunen Loeve Transform).

Also, example cases have been described with the above embodiments where the decoding apparatus according to the above embodiments receives and processes bit streams transmitted from the encoding apparatus according to the above embodiments. However, the present invention is not limited to this, and an essential requirement is that bit streams received and processed in the decoding apparatus according to the above embodiments are transmitted from an encoding apparatus that can generate bit streams that can be processed in the decoding apparatus according to the above embodiments.

Also, the above explanation is an example of the best mode for carrying out the present invention, and the scope of the present invention is not limited to this. The present invention is applicable to any systems as long as these systems include an encoding apparatus and decoding apparatus.

Also, for example, as a speech encoding apparatus and a speech decoding apparatus, the encoding apparatus and the decoding apparatus according to the present invention can be mounted on a communication terminal apparatus and base station apparatus in a mobile communication system, so that it is possible to provide a communication terminal apparatus, base station apparatus and mobile communication system having the same operational effects as above.

Although example cases have been described with the above embodiments where the present invention is implemented with hardware, the present invention can be implemented with software. For example, by describing the algorithm according to the present invention in a programming language, storing this program in a memory and running this program by an information processing section, it is possible to realize the same function as the encoding apparatus according to the present invention.

Furthermore, each function block employed in the description of each of the aforementioned embodiments may typically be implemented as an LSI constituted by an integrated circuit. These may be individual chips or partially or totally contained on a single chip.

"LSI" is adopted here but this may also be referred to as "IC," "system LSI," "super LSI," or "ultra LSI" depending on differing extents of integration.

Further, the method of circuit integration is not limited to LSI's, and implementation using dedicated circuitry or general purpose processors is also possible. After LSI manufacture, utilization of an FPGA (Field Programmable Gate Array) or a reconfigurable processor where connections and settings of circuit cells in an LSI can be reconfigured is also possible.

Further, if integrated circuit technology comes out to replace LSI's as a result of the advancement of semiconductor technology or a derivative other technology, it is naturally also possible to carry out function block integration using this technology. Application of biotechnology is also possible.

The disclosures of Japanese Patent Application No. 2008-143863, filed on May 30, 2008, and Japanese Patent Application No. 2008-160954, filed on Jun. 19, 2008, including the specifications, drawings and abstracts, are incorporated herein by reference in their entireties.

Industrial Applicability

For example, the encoding apparatus and the decoding apparatus according to the present invention are suitably used for mobile phones, IP telephones and television conference, and so on.

The invention claimed is:

1. An encoding apparatus comprising:

a transformer that performs principal component analysis transformation of a first channel signal and a second channel signal of an input stereo signal, to generate a first layer primary signal and a first layer secondary signal;

the encoding apparatus is a scalable encoder having M layers, wherein M>=2;

an m-th layer selector that compares an importance of an m-th layer primary signal with an importance of an m-th layer secondary signal in each layer from a first layer to an M-th layer, and selects a signal of higher importance from the m-th layer primary signal and the m-th layer secondary signal;

an m-th layer encoder that encodes the signal selected in the m-th layer selector, to generate m-th layer encoded data in each layer from the first layer to the M-th layer;

an m-th layer decoder that decodes the m-th encoded data to generate an m-th layer decoded signal in each layer from the first layer to an (M−1)-th layer;

a subtractor that generates a m-th layer residual signal obtained by subtracting the m-th layer decoded signal from the signal selected in the m-th layer selector, wherein the m-th layer residual signal is used as an (m+1)-th layer primary signal and a signal that has lower importance and is not selected in the m-th layer selector is used as an (m+1)-th layer secondary signal, in each layer from the first layer to the (M−1)-th layer;

and a transmitter that transmits encoded data of the first layer to the M-th layer and signal information indicating signals selected in selectors in the first layer to the M-th layer.

2. The encoding apparatus according to claim 1, wherein:

the selector always selects the primary signal in the first layer; and the transmitter transmits the signal information of a second layer to the M-th layer.

3. The encoding apparatus according to claim 1, wherein:

the selector always selects the primary signal in the first layer to an (i−1)-th layer, where i is a natural number equal to or greater than 2 and equal to or less than M; and the transmitter transmits the signal information of an i-th layer to the M-th layer.

4. The encoding apparatus according to claim 1, wherein the importance comprises an indicator represented by signal energy.

5. The encoding apparatus according to claim 1, wherein the importance comprises an indicator represented by a signal to noise ratio.

6. The encoding apparatus according to claim 1, wherein the importance comprises an indicator represented by a mask to noise ratio.

7. An encoding method for a scalable encoder haying M layers, wherein M>=2, the method comprising:

performing principal component analysis transformation of a first channel signal and a second channel signal of an input stereo signal, to generate a first layer primary signal and a first layer secondary signal;

comparing and selecting, by comparing an importance of an m-th layer primary signal with an importance of an m-th layer secondary signal in each layer from a first layer to an M-th layer, and selecting a signal of higher importance from the m-th layer primary signal and the m-th layer secondary signal;

encoding the signal selected in the comparing and selecting, to generate m-th layer encoded data in each layer from the first layer to the M-th layer;

decoding the m-th encoded data to generate an m-th layer decoded signal in each layer from the first layer to an (M−1)-th layer; and generating a m-th layer residual signal obtained by subtracting the m-th layer decoded signal from the signal selected in the comparing and selecting, as an (m+1)-th layer primary signal and a signal that has lower importance and is not selected in the comparing and selecting is used as an (m+1)-th layer secondary signal, in each layer from the first layer to the (M−1)-th layer; and transmitting encoded data of the first layer to the M-th layer and signal information indicating signals selected in the comparing and selecting in the first layer to the M-th layer.

* * * * *